US008639135B2

(12) United States Patent
Okada

(10) Patent No.: US 8,639,135 B2
(45) Date of Patent: Jan. 28, 2014

(54) IMAGE FORMING APPARATUS

(75) Inventor: Noriyuki Okada, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 233 days.

(21) Appl. No.: 13/306,438

(22) Filed: Nov. 29, 2011

(65) Prior Publication Data

US 2012/0155898 A1 Jun. 21, 2012

(30) Foreign Application Priority Data

Dec. 15, 2010 (JP) ..... 2010-279857

(51) Int. Cl.
*G03G 15/01* (2006.01)
*G03G 15/10* (2006.01)

(52) U.S. Cl.
USPC ..... 399/39; 399/60

(58) Field of Classification Search
USPC ..... 399/27, 29, 39, 49, 25, 60
See application file for complete search history.

(56) References Cited

U.S. PATENT DOCUMENTS 6,418,281 B1 7/2002 Ohki
7,035,559 B2 * 4/2006 Tanaka et al. ..... 399/49
7,310,483 B2 * 12/2007 Mizuno ..... 399/39
2010/0061750 A1 3/2010 Okada
2011/0143272 A1 * 6/2011 Urasawa et al. ..... 430/30

FOREIGN PATENT DOCUMENTS

JP 10-039608 A 2/1998
JP 2000-238341 A 9/2000

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

The present image forming apparatus forms a reference developing material image on an image carrier using an exposure unit and a developing unit before executing auto tone correction processing, and detects the density of the reference developing material image formed on the image carrier. If the detection result indicates that the toner charge amount of the developing material contained in the developing unit is within a predetermined range, auto tone correction processing is executed, whereas if the detection result of the density detecting unit indicates that the toner charge amount of the developing material contained in the developing unit is outside the predetermined range, adjustment processing for adjusting the toner charge amount of the developing material contained in the developing unit to be within the predetermined range is executed before execution of auto tone correction processing.

7 Claims, 19 Drawing Sheets

FIG. 21

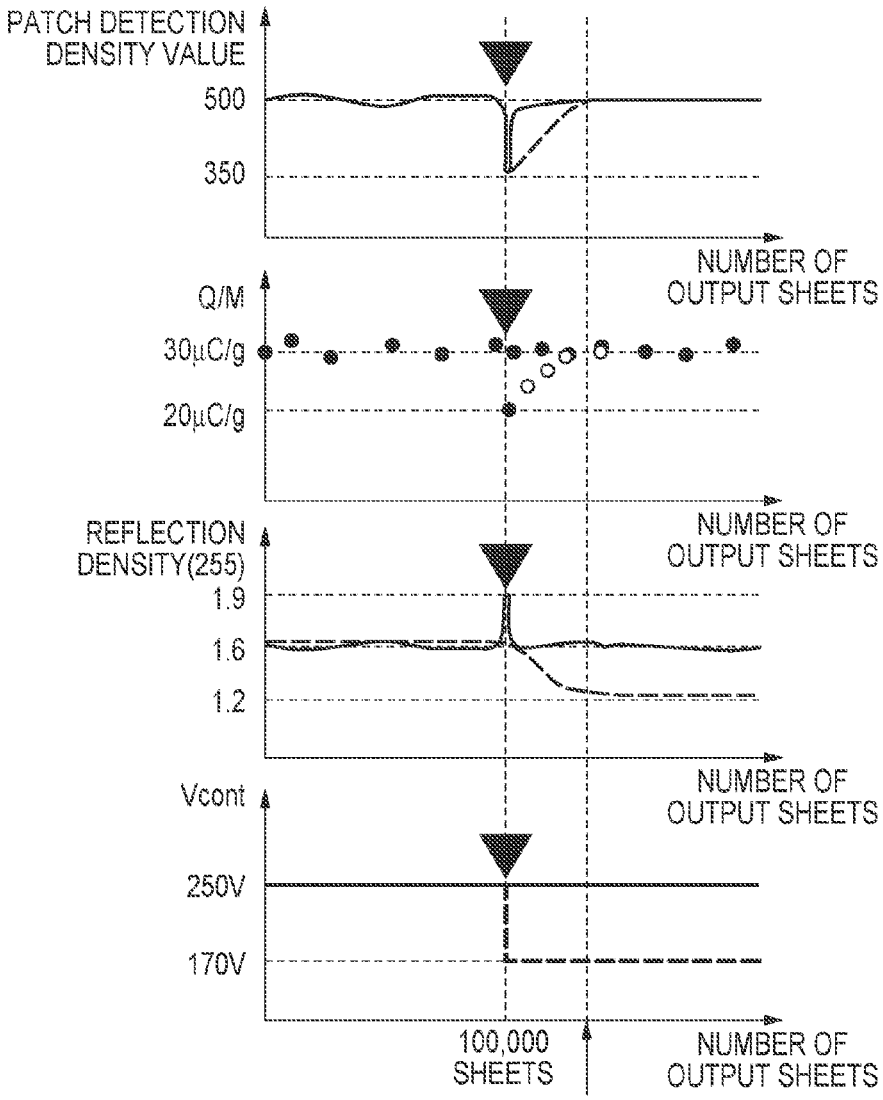

—— EXECUTE AUTO TONE CORRECTION AT THE POINT IN TIME INDICATED BY SOLID INVERTED TRIANGLE(CONTROL ON IN EMBODIMENT)

- - - EXECUTE AUTO TONE CORRECTION AT THE POINT IN TIME INDICATED BY SOLID INVERTED TRIANGLE(CONTROL OFF IN EMBODIMENT)

● EXECUTE AUTO TONE CORRECTION AT THE POINT IN TIME INDICATED BY SOLID INVERTED TRIANGLE(CONTROL ON IN EMBODIMENT)

○ EXECUTE AUTO TONE CORRECTION AT THE POINT IN TIME INDICATED BY SOLID INVERTED TRIANGLE(CONTROL OFF IN EMBODIMENT)

IMAGE FORMING APPARATUS

BACKGROUND OF THE INVENTION

1. Field of the Invention

The present invention relates to an image forming apparatus, such as a copier or a printer, that uses an electrophotographic method or an electrostatic recording method.

2. Description of the Related Art

Among image forming apparatuses, so-called laser printers that use an electrophotographic method, in which a photosensitive member is charged and an image is exposed using a laser beam and developed, are known. Such laser printers have advantages of high image quality, high speed, and the like and are in widespread use as, for example, output apparatuses such as copiers or ordinary printers. A developing device provided in such an image forming apparatus uses a one-component developing material mainly composed of a magnetic toner or a two-component developing material mainly composed of a non-magnetic toner and a magnetic carrier. In particular, most developing devices of image forming apparatuses for forming full-color or multi-color images use a two-component developing material from the standpoint of the tint of images.

In recent years, such image forming apparatuses have been increasingly used in the quick printing market, which is called POD (print on demand), and to keep up with this trend, there is a growing demand for further increases in image quality and stability. One of the items that are regarded as important in achieving the increase in stability is stabilization of density tone characteristics. Since an image forming apparatus is highly sensitive especially to environmental fluctuation, durability fluctuation, and the like in terms of a change in output density, it is necessary to keep the density tone of images in a proper state at all times.

A method for stabilizing the density tone is auto tone correction processing disclosed in Japanese Patent Laid-Open No. 2000-238341. In an example of such a method, a tone pattern image is formed on a recording material, an optical density of this image is read, a γLUT (look up table) is thus created so that desired tone characteristics can be obtained, and tone control is performed with this table. Auto tone correction processing makes it possible to obtain stable density tone characteristics regardless of environmental fluctuation, durability fluctuation, or the like.

Another method for stabilizing the density tone is a method called patch detection ATR (auto toner replenisher) control disclosed in Japanese Patent Laid-Open No. 10-039608, which stabilizes the charge characteristics of a toner. This method stabilizes the charge characteristics of a toner in the case where a two-component developing material is used. A reference image pattern (a patch image) for image density detection is formed on an electrophotographic photosensitive member (a photosensitive member), the patch image is detected by an image density sensor, the amount of toner to be supplied is controlled so that the detection value becomes a predetermined value, and thus the charge characteristics of the toner are stabilized.

However, a problem with auto tone correction processing is that if there is a change in the state, such as the toner charge characteristics, of the developing material after auto tone correction processing, in some cases, optimum density tone characteristics can no longer be maintained. For example, an environmental fluctuation or a time period for which the developing material is left to stand may cause a situation in which when desired toner charge characteristics are not obtained and therefore auto tone correction processing is performed, once the toner charge characteristics return to a desired value by patch detection ATR control after the auto tone correction processing, the density tone characteristics significantly deviate.

As a countermeasure to this problem, Japanese Patent Laid-Open No. 2000-238341 proposes a method for stabilizing the density tone characteristics after auto tone correction processing by changing the density tone characteristics using the density of a patch image on an image carrier. However, with this method, since the density of the patch image on the image carrier is the density before transfer and fixing steps, the accuracy may be inferior to that of auto tone correction processing, which uses the density of the image formed on the recording material, and therefore this method cannot sufficiently meet the recent demand for increased stability. Furthermore, since it is necessary to form a multi-tone patch image in order to enhance the effect of this method, downtime during image formation increases and the amount of toner used also increases, and therefore desired cost effectiveness cannot be achieved.

Meanwhile, it seems that the tone characteristics can be maintained if a target value of patch detection ATR control is changed so that the toner charge characteristics after auto tone correction processing are maintained. However, in this state, a malfunction may occur because the developing material is not in a desired state, that is, for example, the toner charge amount is low. Specifically, it is expected that deterioration in image quality (a decrease in graininess (roughness), background fog, white spots due to transfer defects, and the like), scattering of toner, and the like will occur.

SUMMARY OF THE INVENTION

The present invention enables realization of an image forming apparatus that maintains toner charge characteristics after auto tone correction processing and reduces unnecessary downtime and wasteful toner consumption when performing auto tone correction processing.

One aspect of the present invention provides an image forming apparatus including an image carrier, an exposure unit that forms an electrostatic latent image by exposing the image carrier, and a developing unit that contains a toner and a magnetic carrier as a developing material and that develops the electrostatic latent image formed on the image carrier into a developing material image, and executing auto tone correction processing in which a tone pattern formed on a recording material is read to adjust density tone characteristics, the apparatus comprising: a forming unit that forms a reference developing material image on the image carrier using the exposure unit and the developing unit, before execution of the auto tone correction processing; a density detecting unit that detects a density of the reference developing material image formed on the image carrier; and a control unit that, if a result of detection by the density detecting unit indicates that a toner charge amount of the developing material contained in the developing unit is within a predetermined range, allows the auto tone correction processing to be executed, and if the result of detection by the density detecting unit indicates that the toner charge amount of the developing material contained in the developing unit is outside the predetermined range, executes adjustment processing for adjusting the toner charge amount of the developing material contained in the developing unit to be within the predetermined range, before allowing the auto tone correction processing to be executed.

Further features of the present invention will be apparent from the following description of exemplary embodiments with reference to the attached drawings.

BRIEF DESCRIPTION OF THE DRAWINGS

FIG. 21 is a graph showing the effects of the preparation processing for auto tone correction processing according to the first embodiment.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

Configuration of Image Forming Apparatus

Hereinafter, an example of the configuration of an image forming apparatus according to the present invention will be described with reference to FIG. 2. An image forming apparatus to which the present invention is applied is an image forming apparatus that employs an electrophotographic method. An endless intermediate transfer belt (ITB) 81 that moves in the direction of arrow X is disposed in a main body of the image forming apparatus. This intermediate transfer belt 81 is stretched between three rollers, namely, a drive roller 37, a tension roller 38, and a secondary transfer inner roller 39. The stretching force is 3 kgf in an embodiment of the present invention, but the stretching force may be set to other values. The intermediate transfer belt 81 is made of a dielectric resin or the like, such as a polycarbonate, a polyethylene terephthalate resin film, a polyvinylidene fluoride resin film, a polyimide, or an ethylene-tetrafluoroethylene copolymer, that contains an appropriate amount of carbon black as an antistatic agent and whose volume resistivity is adjusted to 1E+8 to 1E+13 [Ω·cm]; however, other materials and other values of volume resistivity may also be used. In the present embodiment, a seamless belt made of a conductive polyimide having a thickness of 80 μm and a volume resistivity of 1E+10 [Ω·cm] was used. Although the moving speed of the intermediate transfer belt was set to 300 mm/s in the present embodiment, the moving speed may be set to other values.

Figure 2:
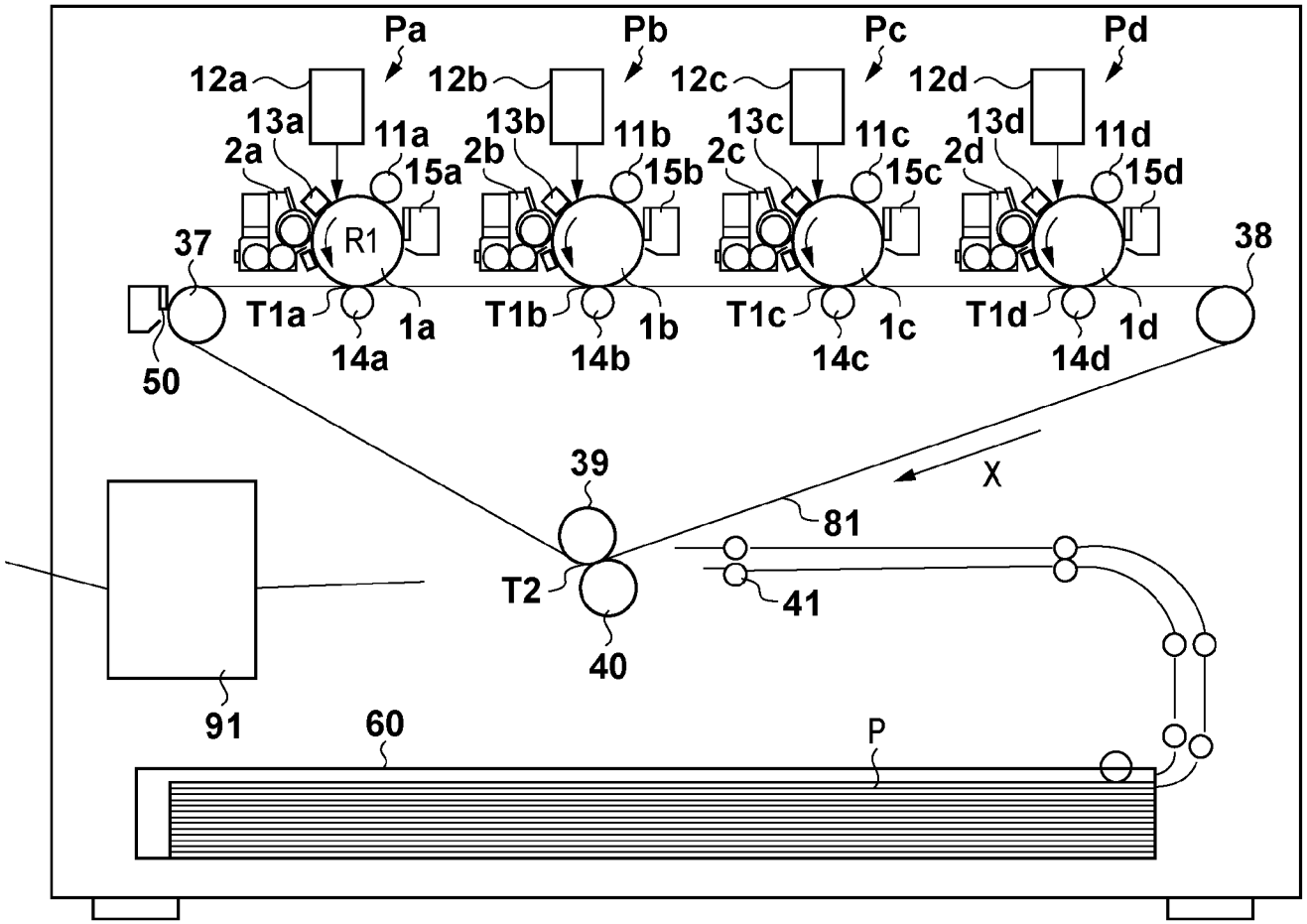
FIG. 2 is a simplified cross-sectional view of an image forming apparatus according to the present invention.

A recording material P taken out from a paper feed cassette 60 is supplied to conveyance rollers 41 via pickup rollers and, furthermore, conveyed to the left-hand side of FIG. 2.

Figure 1:
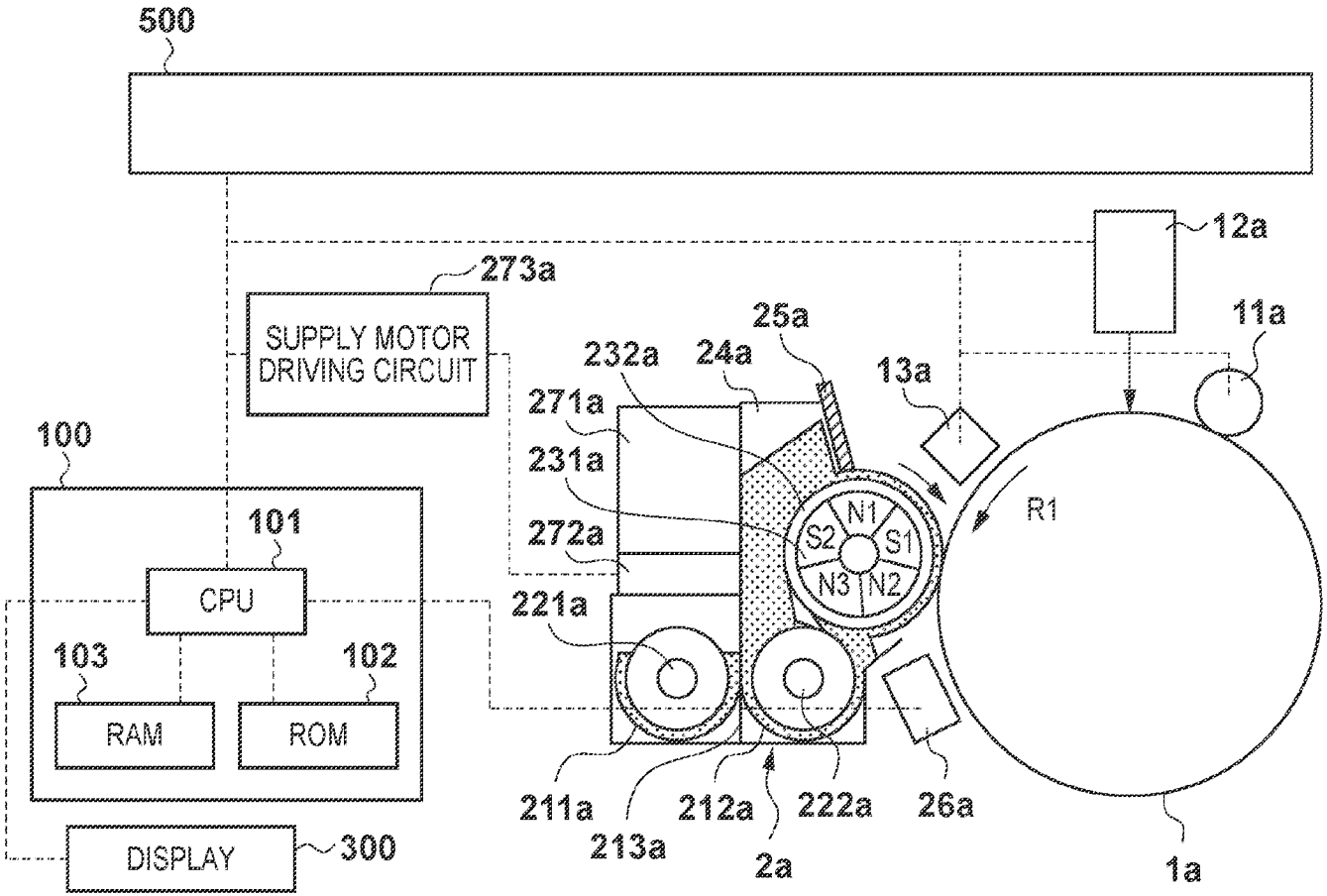
FIG. 1 is a diagram illustrating the vicinity of a photosensitive drum according to the present invention.

Four image forming units Pa, Pb, Pc, and Pd having approximately the same configurations are disposed in series above the intermediate transfer belt 81. The image forming units will be described using the image forming unit Pa as an example. FIG. 1 shows the configuration of the image forming unit Pa in detail. The image forming unit includes a rotatably-disposed drum-like electrophotographic photosensitive member (hereinafter referred to as the "photosensitive drum") 1*a* as an image carrier. The photosensitive drum 1*a* has a support shaft (not shown) in its center and is rotatively driven around this support shaft in the direction of arrow R1 by a driving unit (not shown). In the present embodiment, the surface velocity of the photosensitive drum 1*a* is 300 mm/s, but the surface velocity may be set to other values. Processing devices including a primary charger 11*a*, a scanner unit (an exposure apparatus) 12*a*, a surface potential sensor 13*a*, a developing device 2*a*, a patch detection ATR (auto toner replenisher) sensor 26*a*, a primary transfer roller 14*a*, a cleaning device 15*a*, and the like are disposed around the photosensitive drum 1*a*.

The primary charger 11*a* is a device that comes into contact with the surface of the photosensitive drum 1*a* and uniformly charges this surface to a predetermined polarity and potential, and is generally in the form of a roller (hereinafter referred to as the "charge roller" 11*a*). The charge roller 11*a* is configured of a conductive roller (a cored bar) disposed in its center and a conductive layer formed on an outer circumference of the conductive roller, and the cored bar is rotatably supported by bearing members (not shown) at both ends and is disposed parallel to the photosensitive drum 1*a*. The bearing members at both ends are biased toward the photosensitive drum 1*a* by a pressing unit (not shown). Thus, the charge roller 11*a* is in pressure contact with the surface of the photosensitive drum 1*a* under a predetermined pressing force. The charge roller

11*a* idly rotates with rotation of the photosensitive drum 1*a* in the direction of arrow R1. A bias voltage is applied to the cored bar of the charge roller 11*a* by a power supply (not shown), thereby uniformly contact-charging the surface of the photosensitive drum 1*a*. In the present embodiment, a bias voltage in which a direct current voltage of −700 V and an alternating current voltage of 1.5 kVpp are superimposed is applied to the cored bar of the charge roller 11*a*.

The photosensitive drum 1*a* is irradiated with a laser beam that is emitted from the scanner unit 12*a* disposed downstream of the primary charger 11*a* and that corresponds to an image signal, and thus an electrostatic latent image is formed. The surface potential sensor 13*a*, which is disposed downstream of the scanner unit 12*a*, can measure the potential of the surface of the photosensitive drum 1*a*. It is possible to change the intensity of the laser beam from the scanner unit 12*a* in a range between 0 and 255, and the potential of the latent image can be changed by changing the intensity of the laser beam. In the present embodiment, the value of the surface potential sensor 13*a* when the intensity L of the laser beam is changed between 0 and 255 is expressed as V(L) (V(L=0) to V(L=255)).

The developing device 2*a* disposed downstream of the surface potential sensor 13*a* employs a two-component developing method that uses a two-component developing material containing a non-magnetic toner and a magnetic carrier. In the present embodiment, a negatively charged toner was used. The interior of the developing device 2*a* is partitioned into a developing chamber 212*a* and a stirring chamber 211*a* by a partition wall 213*a* extending in a vertical direction at a developing position. In the developing chamber 212*a*, a non-magnetic developing sleeve 232*a* serving as a developing material carrier is disposed, and a magnet 231*a* serving as a magnetic field generating unit is fixedly disposed in this developing sleeve 232*a*. The magnet 231*a* is configured of about three or more poles. Although a five-pole magnet was used in the present embodiment, magnets with other numbers of poles may also be used.

First and second conveyance screws 222*a* and 221*a* serving as developing material stirring and conveying units are disposed in the developing chamber 212*a* and the stirring chamber 211*a*, respectively. The first conveyance screw 222*a* stirs and conveys the developing material in the developing chamber 212*a*. The second conveyance screw 221*a* stirs and conveys a toner that has been supplied from a toner supply vessel 271*a* by rotation of a toner conveyance screw (not shown) in a toner supply unit 272*a* and a developing material that already exists in the developing device 2*a*, and renders the toner density of the developing material uniform. Developing material passages that allow the developing chamber 212*a* and the stirring chamber 211*a* to communicate with each other at front and back ends are formed in the partition wall 213*a* between the developing chamber 212*a* and the stirring chamber 211*a*. Due to the conveying force of the first and second conveyance screws 222*a* and 221*a*, the developing material in the developing chamber 212*a*, whose toner density has been decreased as a result of toner consumption due to development, moves to the stirring chamber 211*a* through one passage. The developing material whose toner density has been recovered in the stirring chamber 211*a* moves to the developing chamber 212*a* through the other passage.

The two-component developing material that has been stirred by the first conveyance screw 222*a* in the developing device 2*a* is bound by the magnetic force of a conveyance magnetic pole (a drawing-up pole) N3 for drawing up the developing material, and the developing material is conveyed on the developing sleeve 232*a* due to rotation of the developing sleeve 232*a*. Then, the amount of the developing material is regulated by a developing material return member 24*a*, the developing material is sufficiently bound by a conveyance magnetic pole (a cutting pole) S2 having a magnetic flux density of a certain level or higher in order to bind a stable amount of the developing material, and is conveyed while forming a magnetic brush.

Subsequently, the thickness of the developing material layer is optimized by a regulating blade 25*a* trimming off a magnetic head, and as the conveyance magnetic pole N1 and the developing sleeve 232*a* rotate, the developing material is conveyed to a developing area opposing the photosensitive drum 1*a*. Then, a magnetic head is formed by a developing pole S1 in the developing area, only the toner is transferred onto the electrostatic latent image on the photosensitive drum 1*a* due to a developing bias applied to the developing sleeve 232*a*, and thus a developing material image corresponding to the electrostatic latent image is formed on the surface of the photosensitive drum 1*a*. Although a magnetic plate having a thickness of 1.0 mm was used as the regulating blade 25*a* in the present embodiment, other thicknesses or other materials such as a non-magnetic plate may also be used.

In order to improve the developing efficiency, that is, the rate of providing the toner to the latent image, a predetermined developing bias is applied to the developing sleeve 232*a* from a developing bias power supply (not shown) serving as a developing bias output unit. In the present embodiment, a developing bias voltage in which an alternating current voltage (V(DevAC)) is superimposed on a direct current voltage (V(DevDC)) is applied to the developing sleeve 232*a* from the developing bias power supply. Although V(DevDC) =−520 V and V(DevAC)=1.5 kVpp were used in the present embodiment, other bias values may also be used. The supply of the toner by the toner conveyance screw in the toner supply unit 272*a* is controlled by a CPU 101 of a control unit 100 that will be described later controlling the rotation of the toner conveyance screw via a motor driving circuit 273*a*. A ROM 102 connected to the CPU 101 stores control data and the like to be supplied to the motor driving circuit 273*a*.

The patch detection ATR sensor 26*a*, which is disposed downstream of the developing device 2*a*, can optically examine the image density of the developing material image formed on the photosensitive drum 1*a* by detecting the quantity of reflected light.

The primary transfer roller 14*a* is disposed downstream of the patch detection ATR sensor 26*a*. The primary transfer roller 14*a* is formed of a conductive roller shaft (a cored bar (not shown)) having a diameter of 8 mm and a cylindrical conductive layer formed on an outer circumferential surface of the shaft, and the diameter of the primary transfer roller 14*a* is 16 mm. Although a conductive layer whose resistivity was adjusted to a medium resistivity region of 106 to 108 Ω·cm by mixing an ionic conductive material in a polymeric elastomer or a polymeric foam composed of rubber, urethane, or the like was used as the above-described conductive layer, materials having other properties may also be used. Both ends of the primary transfer roller 14*a* are biased toward the photosensitive drum 1*a* by a pressing member (not shown) such as a spring, and thus the transfer roller 14*a* is in pressure contact with the photosensitive drum 1*a* side under a predetermined pressing force with the intermediate transfer belt 81 sandwiched between them, so that a primary transfer nip portion T1*a* is formed. Although pressing force is 1.5 kgf in the present embodiment, the pressing force may be set to other values.

The cleaning device 15*a* is disposed downstream of the primary transfer nip portion T1*a*. The toner remaining on the photosensitive drum 1*a* is removed by a cleaning blade in the cleaning device 15*a*. In the present embodiment, polyurethane rubber was used as the material for the cleaning blade, and the contact pressure between the cleaning blade and the photosensitive drum 1*a* was set to 1000 gf. However, other materials and other pressure values may also be used.

The other image forming units Pb, Pc, and Pd have configurations similar to that of the image forming unit Pa, and the image forming unit Pa and the image forming units Pb, Pc, and Pd are different in that these image forming units form a developing material image in yellow, magenta, cyan, and black, respectively. The developing devices 2*a*, 2*b*, 2*c*, and 2*d* contain a yellow toner, a magenta toner, a cyan toner, and a black toner, respectively, and toner supply vessels 271*a*, 271*b*, 271*c*, and 271*d* contain supply toners for the yellow toner, the magenta toner, the cyan toner, and the black toner, respectively.

An image signal due to a yellow component color of an original is projected, via a polygon mirror and the like, onto the photosensitive drum 1*a*, which is charged to a negative polarity by the primary charger 11*a*, so that an electrostatic latent image is formed, and the yellow toner is supplied from the developing device 2*a* onto this latent image, thereby changing the electrostatic latent image to a yellow developing material image. With the rotation of the photosensitive drum 1*a*, this developing material image reaches the primary transfer nip portion T1*a* in which the photosensitive drum 1*a* and the intermediate transfer belt 81 are brought into contact with each other, and then the yellow developing material image is transferred onto the intermediate transfer belt 81 due to a primary transfer bias applied to the transfer roller 14*a*.

The toner remaining on the photosensitive drum 1*a* after the transfer is removed by the cleaning device 15*a*. When the intermediate transfer belt 81 carrying the yellow developing material image is moved to the image forming unit Pb, a magenta developing material image, which has been formed on the photosensitive drum 1*b* in the image forming unit Pb by that moment in the same manner as described above, is transferred onto the yellow developing material image.

Similarly, a cyan developing material image and a black developing material image are transferred and superimposed onto the above-described developing material images, and by that time, the recording material P taken out from the paper feed cassette 60 is transported. A leading edge of the recording material P is stopped at the conveyance rollers 41, and the recording material P is transported from the conveyance rollers 41 at an appropriate timing so that the images formed on the intermediate transfer belt 81 can be transferred to a predetermined position on the recording material P. The transported recording material P reaches a secondary transfer unit T2 in which the secondary transfer inner roller 39 and a secondary transfer outer roller 40 are brought into contact with each other via the intermediate transfer belt 81. Here, the above-described developing material images in the four colors are transferred onto the recording material P by a secondary transfer bias applied to the secondary transfer outer roller 40. The secondary transfer outer roller 40 is formed of a conductive roller shaft (a cored bar) having a diameter of 12 mm and a cylindrical conductive layer formed on an outer circumferential surface of the shaft, and the diameter of the secondary transfer outer roller 40 is 24 mm. Although a conductive layer whose resistivity was adjusted to a medium resistivity region of 106 to 108 Ω·cm by mixing an ionic conductive material in a polymeric elastomer or a polymeric foam composed of rubber, urethane, or the like was used as this conductive layer, materials having other properties may also be used. The secondary transfer inner roller 39 is a conductive roller, which has a diameter of 21 mm and is preferably made of SUS, Al, or the like. It should be noted that the toner on the intermediate transfer belt 81 is transferred onto the recording material P passing through the secondary transfer unit by applying a transfer bias to either the secondary transfer inner roller 39 or the secondary transfer outer roller 40. Here, the negatively charged toner on the intermediate transfer belt is transferred onto the recording material P by applying a positive bias to the secondary transfer outer roller 40.

The cleaning device 50 is disposed downstream of the secondary transfer unit T2. The toner remaining on the intermediate transfer belt 81 is removed by the cleaning blade in the cleaning device 50. Although polyurethane rubber was used as the material for the cleaning blade in the present embodiment, the cleaning blade may also be made of other materials. It should be noted that although the contact pressure between the cleaning blade and the intermediate transfer belt 81 was set to 1000 gf in the present embodiment, the contact pressure may be set to other values.

After passing through the secondary transfer unit T2, the recording material P is separated from the intermediate transfer belt 81 and conveyed to a fixing apparatus 91. The fixing apparatus 91 applies heat and pressure to the developing material images that have been transferred onto the recording material P, and thus the developing material images are melted and mixed, and also fixed onto the recording material P. Subsequently, the recording material P is discharged to the outside of the image forming apparatus.

Reading Process

Next, a process for reading an original will be described with reference to FIG. 3. Once a "Copy" key (not shown) of an operation unit is pressed, a pre-scanning step, which is a preparation step for image formation, is started, and an irradiation light source 503 irradiates an original 501 placed on an original platen 502 with light. The light emitted by the irradiation light source 503 and reflected from the original 501 passes through an imaging element array 504 and an infrared cut-off filter 505 to reach a CCD (a contact color sensor CCD) 506, and is imaged thereon.

Figure 3:
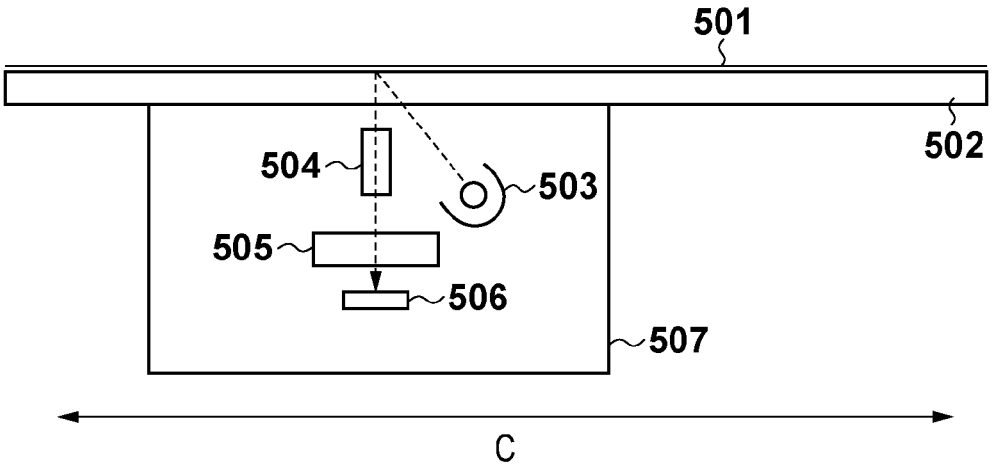
FIG. 3 is a diagram illustrating an original reading unit 500 according to the present invention.
Figure 4:
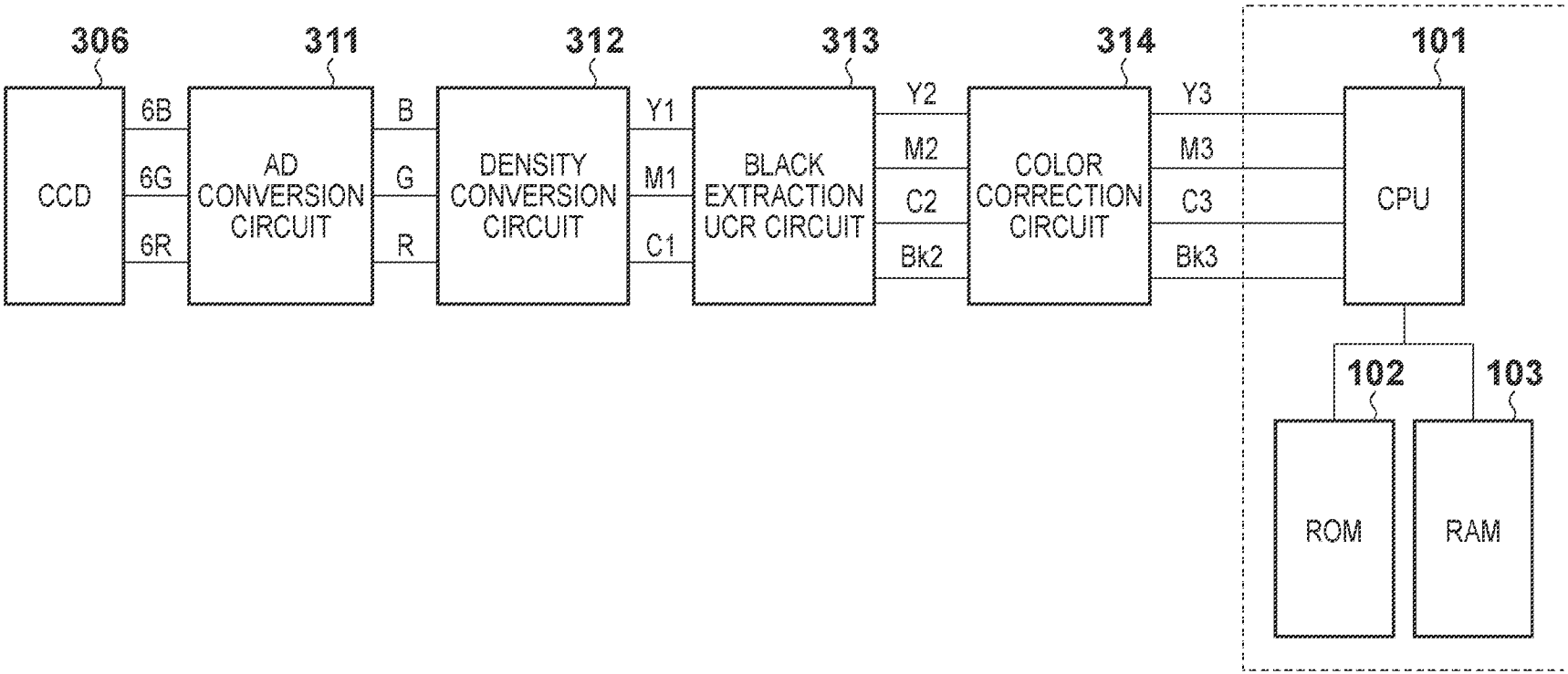
FIG. 4 is a diagram illustrating image signal arithmetic processing in the original reading unit 500 according to the present invention.
Figure 5:
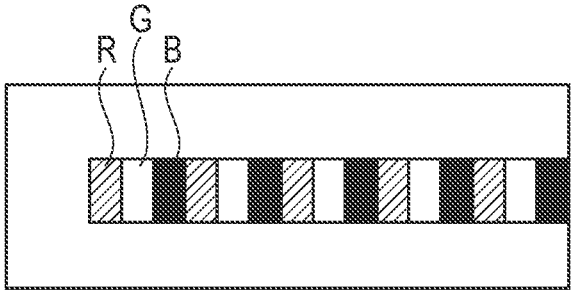
FIG. 5 is a diagram showing the configuration of a CCD 506 according to the present invention.

An optical system unit 507 moves in the direction of arrow C in FIG. 3 while successively scanning the original 501 on the original platen 502. Then, the range of the original is determined based on image information (FIG. 5) read by the CCD 506, and detected RGB image signals are processed into yellow, magenta, cyan, and black color signals in compliance with image processing illustrated in FIG. 4. After that, the image signal pf each pixel is recorded in a RAM 103 through the CPU 101, and an image is formed based on those image signals.

Toner Supply Control

Hereinafter, toner supply control according to an embodiment of the present invention will be described. Development of an electrostatic latent image results in a decrease in the density of the developing material in the developing device 2. For this reason, it is necessary for a density control apparatus to perform control (toner supply control) for supplying the toner from the toner supply vessel 271 to the developing device 2. This makes it possible to control and keep the toner density of the developing material as constant as possible or to control and keep the image density as constant as possible. A density control apparatus that employs a method (a patch detection ATR) in which control is performed by creating a patch image for reference (a reference developing material image) on the photosensitive drum 1 and detecting the image density of the created image with the image density sensor (the patch detection ATR sensor) 26 that is disposed opposing the photosensitive drum 1 is provided.

Figure 6:
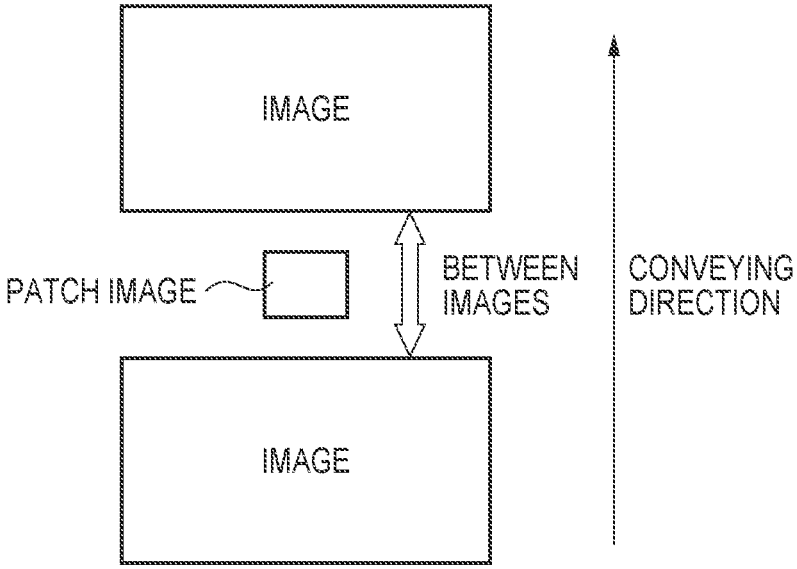
FIG. 6 is a diagram showing the position of a patch image according to the present invention.

In the present embodiment, during continuous image formation, as shown in FIG. 6, the CPU 101 causes an image pattern for image density detection (a patch image) Q to be formed in a non-image area (hereinafter referred to as "between images") sandwiched between a trailing edge of a preceding image in a conveying direction and a leading edge of the following image. It should be noted that in the following description, an electrostatic latent image of the patch image may also be referred to as a "patch latent image". This patch latent image is developed by the developing device 2 into a developing material image. This patch latent image is always formed under the same latent image conditions, and if the state of the developing material is the same, the toner density of the developed developing material image will be the same.

The quantity of light reflected from the patch image Q on the photosensitive drum 1 is measured by the patch detection ATR sensor 26. The patch detection ATR sensor 26 has a light emitting unit that is provided with a light emitting element such as an LED and a light receiving unit that is provided with a light receiving element such as a photodiode (PD). The patch detection ATR sensor 26 measures the above-described reflected light quantity at the timing when the patch image Q that has been formed between images on the photosensitive drum 1 passes under the patch detection sensor 26. A signal related to the result of this measurement is input to the CPU 101. After that, the CPU 101 calculates the patch density using a density conversion table that is recorded in advance, and obtains the amount of correction for the amount of toner to be supplied, which is estimated to provide a desired density (reflected light quantity). In the present embodiment, the smaller the value of the patch density converted with the density conversion table, the larger the amount of toner of the patch developing material image. For example, in the case where the patch density when the developing material is in the initial state is 500 and the measured patch density is 400, an increase in the toner density of the patch as compared to that of the initial state is indicated.

In the present embodiment, during ordinary image formation, control is performed in such a manner that a patch image Q is formed in the non-image area, the density of the formed patch image is detected to calculate the amount of toner to be supplied, and the value of an image signal to be output is corrected whenever necessary.

Next, toner supply control that uses a video count ATR will be described. In the present embodiment, by means of the video count ATR and the patch detection ATR, the amount of toner to be supplied M is obtained from Formula 1 below:

$$(\text{amount of toner to be supplied: } M)=Mv+Mp \qquad \text{(Formula 1)}$$

where Mv represents the amount of toner to be supplied that is obtained by the video count ATR and Mp represents the amount of toner to be supplied that is obtained by the patch detection ATR (hereinafter referred to as the "supply correction amount"). As described above, the supply correction amount is obtained from the difference ΔD between the detected value of the density of the patch image Q with the initial developing material, the detected value serving as a reference value, and the measurement result. For example, if the density of the patch image Q with the initial developing material is $D_p$(initial)=500 and the density of the patch image Q that is measured when the image forming apparatus outputs the patch image onto an X-th sheet is $D_p$(X)=400:

$$\Delta D_p(X)=D_p(X)-D_p(\text{initial})=-100 \qquad \text{(Formula 2)}$$

That is to say, for example, the variation in the density of the patch image Q when the toner in the developing device 2 deviates from the reference value by an amount of 1 g (a reference amount) is taken as ΔD (reference), and this ΔD (reference) is stored in the ROM 102. Thus, the CPU 101 obtains the supply correction amount Mp from Formula 3 below:

$$Mp=\Delta D_p(X)/\Delta D_p(\text{reference}) \qquad \text{(Formula 3)}$$

Moreover, Mv (hereinafter referred to as the "basic supply amount") is obtained from an image signal to be output. This video count value is converted into the basic supply amount Mv using a table indicating the relationship between video count values that are recorded in advance and the amounts of toner to be supplied. This table is stored in the ROM 102 in advance. In this manner, each time an image is formed, the basic supply amount Mv for the image is calculated.

The CPU 101 of the control unit 100 obtains the amount of toner to be supplied M in the above-described manner. In other words, in the present embodiment, the electrostatic latent image on the photosensitive drum 1 is digitally formed. Then, a toner supply operation is performed based on digital image signals for each pixel of the electrostatic latent image formed on the photosensitive drum 1, in addition to the detection result of the patch detection ATR sensor 26.

Auto Tone Correction Processing

Figure 7:
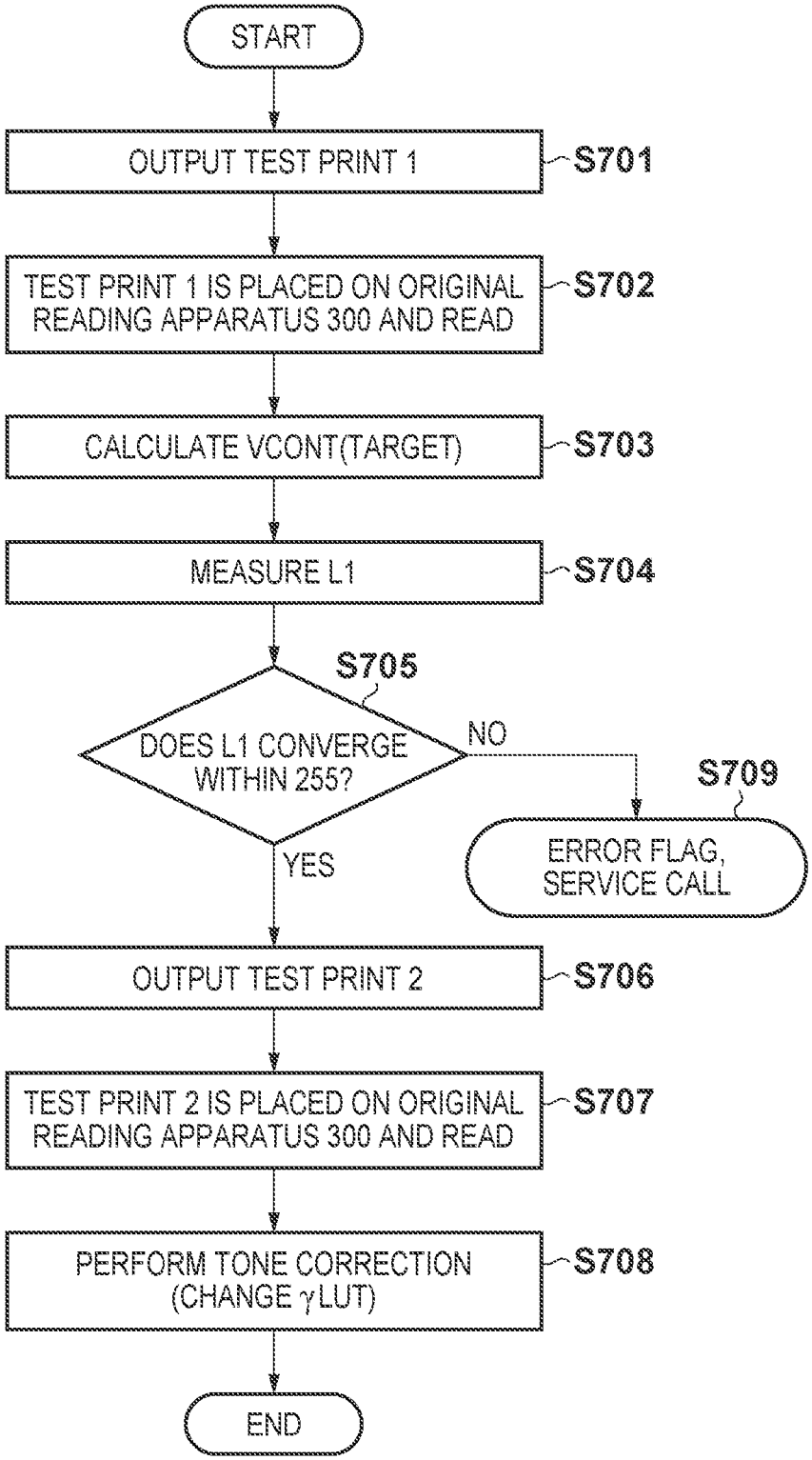
FIG. 7 is a flowchart of auto tone correction processing according to the present invention.

Next, auto tone correction processing will be described with reference to FIG. 7. With regard to auto tone correction processing, a method in which the image density of a tone image formed on the recording material P is read using the original reading unit 500 to adjust image tone characteristics will be discussed; however, the original reading unit 500 may be replaced by other density sensors. The present control is started by pressing an "Auto tone correction processing" mode setting button provided on the operation unit of the image forming apparatus. It should be noted that in the present embodiment, the display 300 is configured of a liquid crystal operation panel (a touch screen display) equipped with a push sensor as shown in FIGS. 8A to 10E, and it is possible to directly perform an operation on the display 300.

Figure 8A:
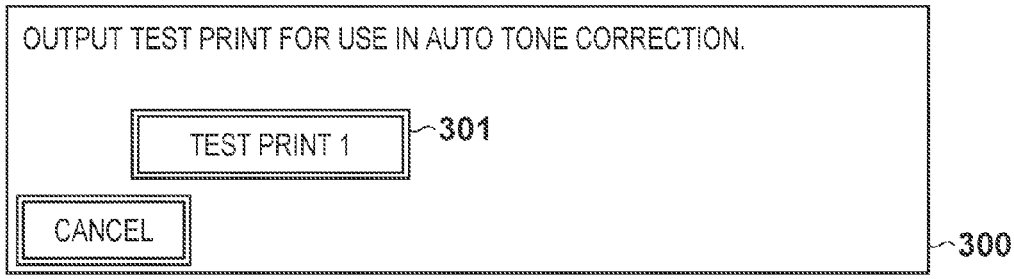
FIGS. 8A-8C are diagrams showing display on a display 300 when a test print 1 is output according to the present invention.
Figure 8B:
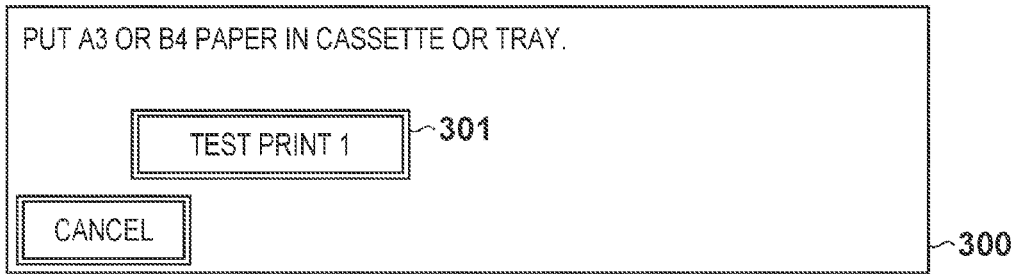
Figure 8C:
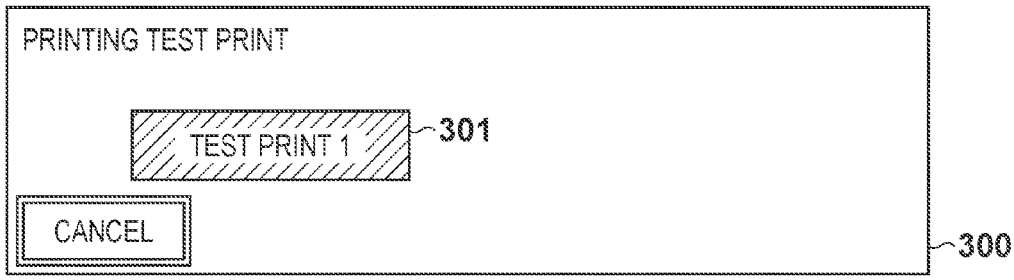

First, once the "Auto tone correction processing" mode setting button is pressed, a print start button 301 for a test print 1 appears on the display 300 (FIG. 8A). Once the print start button 301 is pressed, the image forming apparatus prints an image of the test print 1 in step S701. At this time, the CPU 101 judges whether or not there is paper for forming the test print 1, and if the paper is not present, a warning as shown in FIG. 8B is displayed. With regard to a contrast potential (described later) during formation of this test print 1, a contrast potential under standard conditions appropriate for the environment is registered as an initial value in advance, and this value is used.

Moreover, the image forming apparatus according to the present embodiment includes a plurality of paper cassettes and allows a plurality of types of paper size, such as B4, A3, A4, and B5, to be selected. However, with regard to the print paper (the recording material) for use in this control, so-called large-sized paper is employed in order to avoid an error due to confusion between portrait and landscape orientations during a subsequent reading operation. Specifically, it is set so that B4, A3, 11×17, or LGR is used.

Figure 11:
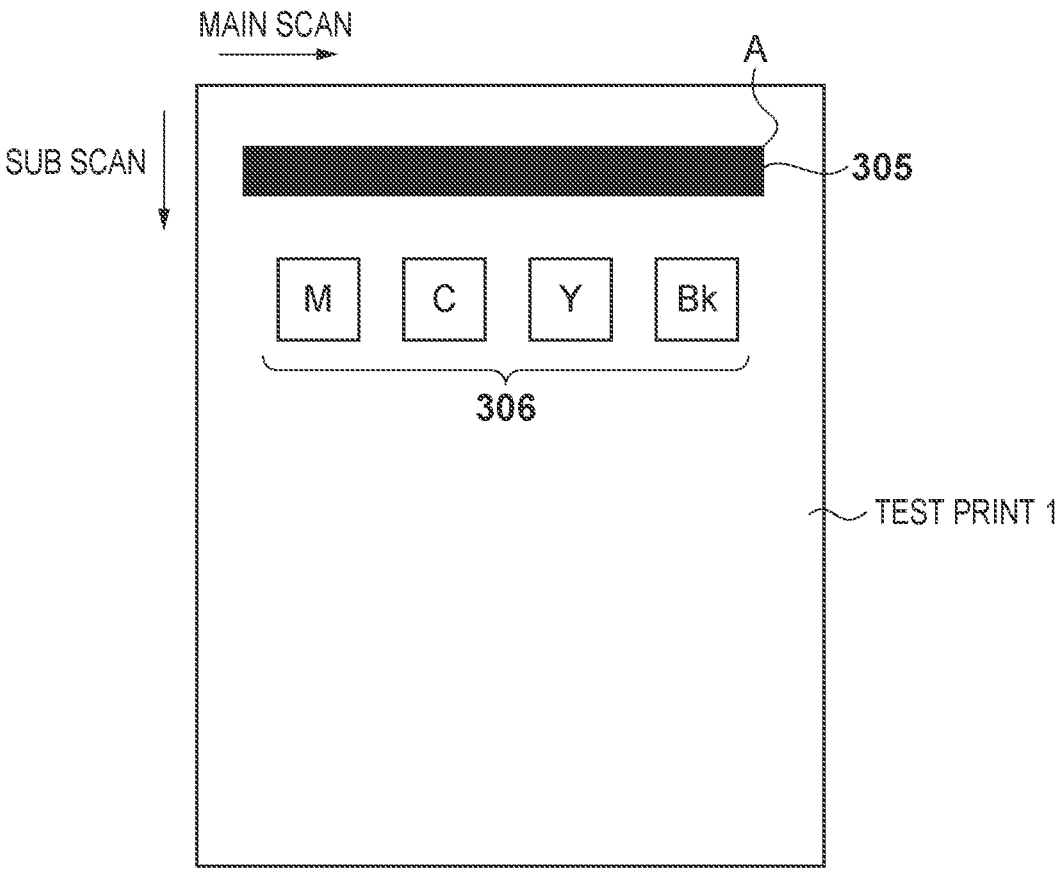
FIG. 11 is a diagram showing an image of the test print 1 according to the present invention.

Here, FIG. 11 shows a test pattern 1 formed on the test print 1. In the test pattern 1, a band-like pattern 305 composed of half-tone densities of four colors Y, M, D, and Bk is formed. This pattern 305 is visually inspected to confirm that there is no streaked abnormal image, density unevenness, and color unevenness. As shown in FIG. 11, the size of the pattern 305 in a longitudinal direction (a main-scanning direction) is set to the size of the CCD sensor in the main-scanning direction so as to cover a patch pattern 306 (described later) and tone patterns 307 and 308 for a test print 2 shown in FIG. 12. Meanwhile, the pattern 306 is composed of maximum density patches of respective colors Y, M, C, and Bk and uses a density signal value level of 255.

It is assumed that if an abnormality is found, printing of the test print 1 is performed once more, and if an abnormality is found again, it is necessary to contact a service engineer. It should be noted that it is also possible to read this band pattern 305 with the original reading unit 500 and judge whether or not to perform subsequent control based on density information in the longitudinal direction of the pattern.

Figure 9A:
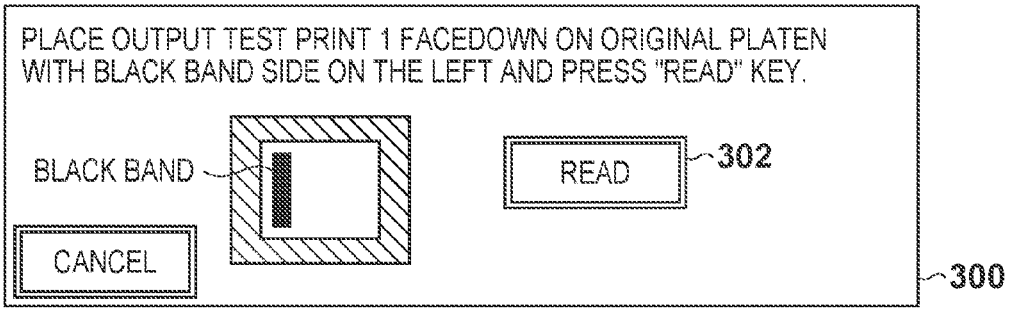
FIGS. 9A-9C are diagrams showing display on the display 300 when the test print 1 is read according to the present invention.
Figure 13:
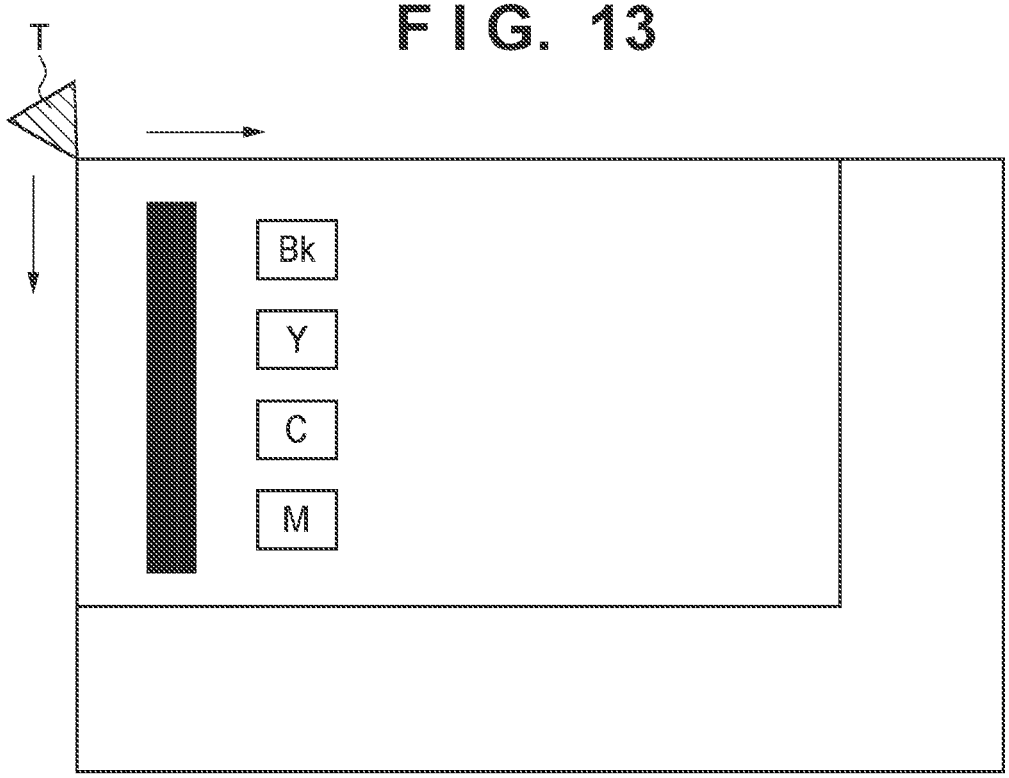
FIG. 13 is a diagram showing how the test print 1 according to the present invention is placed on the original reading unit 500.

Next, in step S702, the output image of the test print 1 is placed on the original platen glass 501 as shown in FIG. 13, and a reading start button 302 shown in FIG. 9A is pressed. At this time, guidance for an operator shown in FIG. 9A is displayed.

FIG. 13 shows the original platen as viewed from above, and a wedge-shaped mark T at the upper left indicates a mark on the original platen for alignment of an edge of the original. The operator is required to place the test print 1 on the original platen in such a manner that the band pattern 305 is located on the alignment mark T side and the original is placed with the proper side up. On an operation panel, as shown in FIG. 9A, a message such as, for example, "place output test print 1 facedown on original platen with black band side on the left and press 'Read' key" is displayed. Displaying such a message can prevent a control error due to misplacement.

During reading of the pattern 306, the original reading unit 500 gradually performs scanning from the alignment mark T, and since a corner A of the pattern 305 is first detected as shown in FIG. 11, the original reading unit 500 calculates (predicts) the position of each patch of the pattern 306 as coordinates relative to the coordinate point of the corner A and reads the density values of the pattern 306. That is to say, the original reading unit 500 can predict the start timing of reading of the pattern 306 by reading the corner A of the pattern 305.

Figure 9B:
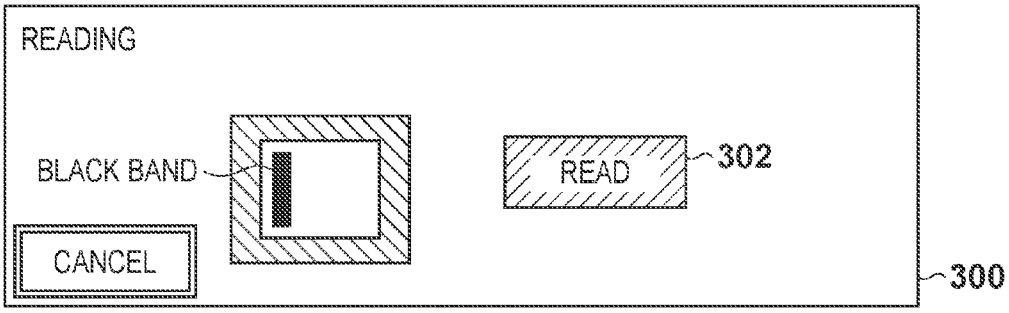
Figure 9C:
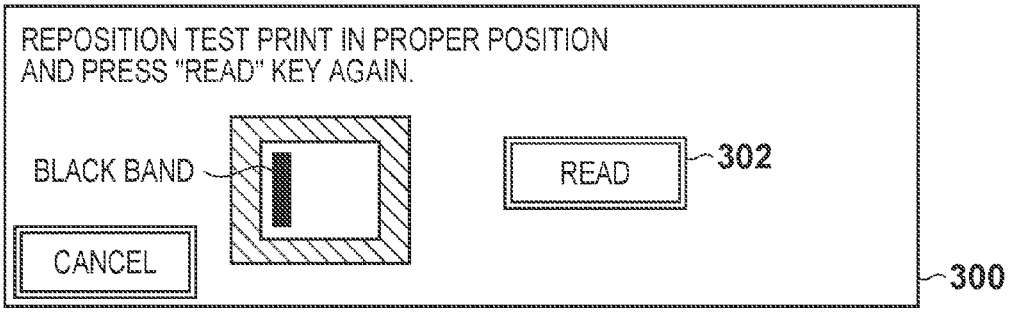

During reading, a display shown in FIG. 9B is presented. When reading is impossible due to an incorrect orientation or position of the test print 1, a message shown in FIG. 9C is displayed, and once the operator repositions the test print 1 and presses the reading start button 302, reading is performed again.

In order to convert the obtained RGB values to the optical density, Formula 4 below is used:

$$M=-km\times\log 10(G/255),$$

$$C=-kc\times\log 10(R/255),$$

$$Y=-ky\times\log 10(B/255), \text{ and}$$

$$Bk=-kbk\times\log 10(G/255) \qquad \text{(Formula 4)}$$

Here, in order to obtain the same values as those of a commercially available densitometer, adjustment is made using a correction coefficient (k). Moreover, it is also possible to convert RGB luminance information to MCYBk density information using a LUT separately. The CPU 101 records the density value of each color D1 (D1(M), D1(C), D1(Y), and D1(Bk)) obtained using Formula 4 in the RAM 103.

Figure 15:
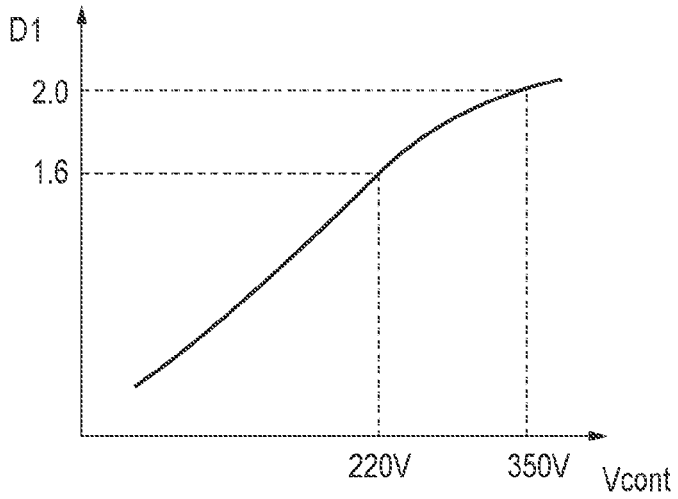
FIG. 15 is a graph showing a relationship between Vcont and density according to the present invention.

Next, in step S703, the CPU 101 calculates a contrast potential Vcont(target). FIG. 15 shows a relationship between the contrast potential Vcont and the density value D. The contrast potential Vcont is obtained as the difference between the value V(L) of the surface potential sensor 13 at a laser beam intensity L and the direct current voltage V(DevDC) of the developing bias. When V(L)=−300 V and V(DevDC)=−520 V, Vcont is Vcont=V(L)−V(DevDC)=220 V.

As shown in FIG. 15, at a density value D close to 1.6, the relationship between the contrast potential Vcont and the density value D has linearity. At a density value D near 2.0, the linearity can no longer be retained. This is due to the reading accuracy of the original reading unit 500 and a decrease in the developing efficiency, and this area may change depending on the configuration of the original reading unit 500 or the image forming apparatus. Moreover, at a density value D close to 1.6, since the relationship between the contrast potential Vcont and the density value D has linearity, if the relationship between the contrast potential Vcont and the density value D at a certain point are known, it is possible to find the contrast potential Vcont(target) that is necessary to obtain a desired density value.

Based on the above-described relationship, the contrast potential Vcont(target) can be expressed, using a target density D(target) when the maximum density signal value is 255, the contrast potential Vcont1 in the case of the test print 1, and D1, as in Formula 5:

$$Vcont(\text{target})=a\times Vcont1/D1\times D(\text{target}) \qquad \text{(Formula 5)}$$

where "a" is a coefficient obtained from the slope of the graph and is recorded in the ROM 102 in advance along with D(target) and Vcont1. Although D(target) is set to 1.6 in the present embodiment, D(target) may be set to other values. However, when D(target) is set to an extremely high value, there is a possibility that the accuracy may be decreased due to the relationship in FIG. 15. In this manner, if the measurement value of D1 can be found, Vcont(target) can be obtained.

Figure 16:
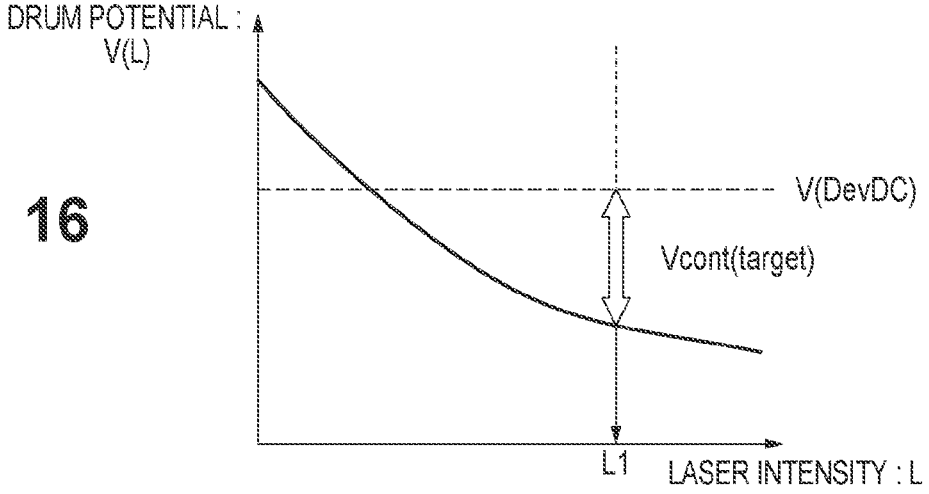
FIG. 16 is a graph illustrating how Vcont is determined during auto tone correction processing according to the present invention.

Next, in step S704, the CPU 101 measures the laser intensity L1. FIG. 16 shows a relationship between the laser beam intensity L and the photosensitive drum potential V(L) (the value on the surface potential sensor 13). As shown in FIG. 16, the CPU 101 obtains the laser beam intensity L1 at the time when Vcont(target) can be obtained and records the laser beam intensity L1 in the RAM 103. Moreover, at this time, the CPU 101 records the ratio of Vcont(target) to Vcont1 Vcont (target)/Vcont1 in the RAM 103 as a Vrate value. With Vrate recorded in advance, even when an environmental fluctuation requires the Vcont value to be changed, the situation can be dealt with using the data recorded in the ROM 102.

Here, in step S705, the CPU 101 judges whether or not L1 converges within 255. If L1 converges, the process is advanced to step S706, and if not, the process is advanced to step S709, and an error flag is set. Specifically, if Vcont (target) cannot be obtained even at a laser beam intensity L of 255, there is a possibility that a malfunction may occur in the image forming apparatus, and therefore an error flag is set in step S709. Furthermore, it is desirable that the error flag can be seen by the service engineer in a predetermined service mode.

Figure 10A:
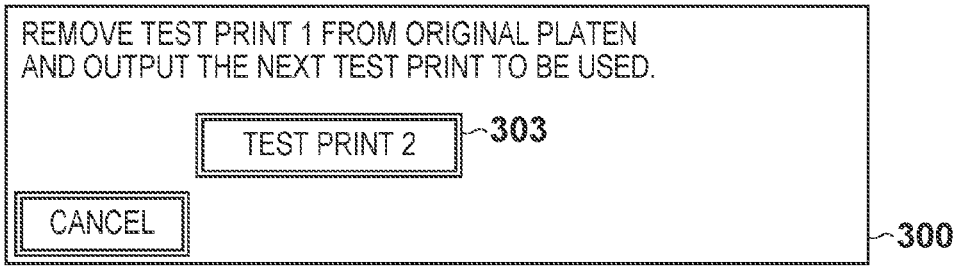
FIGS. 10A-10E are diagrams showing display on the display 300 when a test print 2 is output according to the present invention.
Figure 10B:
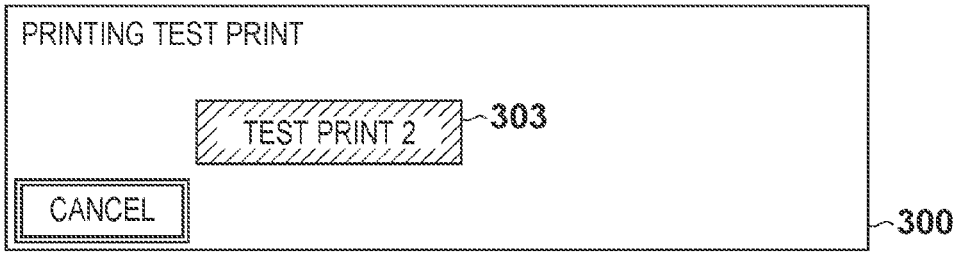
Figure 12:
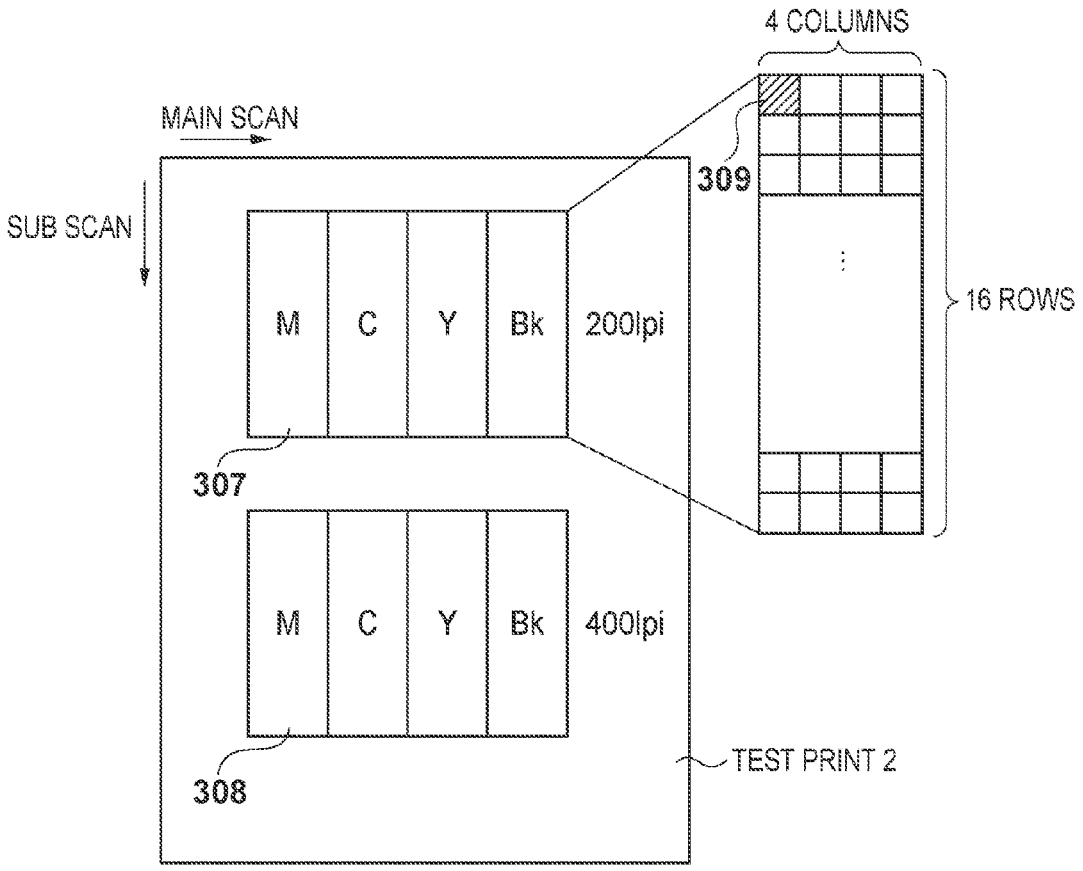
FIG. 12 is a diagram showing an image of the test print 2 according to the present invention.

Next, in step S706, the CPU 101 outputs the test print 2. As shown in FIG. 10A, a print start button 303 for an image of the test print 2 is displayed on the operation panel, and the image of the test print 2 in FIG. 12 is printed out by pressing the button 303. During printing, a display as shown in FIG. 10B is presented.

As shown in FIG. 12, the test print 2 is composed of a group of patches that are arranged in 4 columns and 16 rows, the columns respectively corresponding to the colors Y, M, C, and Bk, and that represent gradations of a total of 64 tones. Here, with respect to the 64 tones, laser output levels are predominantly assigned to tones in a low-density region of a total of 256 tones, and in a high-density region, laser output levels are decimated. In this manner, it is possible to favorably adjust the tone characteristics especially in a highlighted portion.

In FIG. 12, reference numeral 307 indicates patches at a resolution of 200 lpi (lines/inch), and reference numeral 308 indicates patches at a resolution of 400 lpi (lines/inch). Formation of an image at each resolution can be realized by preparing a plurality of triangle waves of different periods for use in comparison with the image data to be processed in a pulse width modulation circuit (not shown).

It should be noted that, in the present image forming apparatus, a tone image is formed at a resolution of 200 lpi, and a line image such as a character is formed at a resolution of 400 lpi. Patterns of the same tone level are output at the above-described two different resolutions; however, in the case where the difference in resolution leads to a large difference in tone characteristics, it is more preferable to set the above-described tone level in accordance with the resolution.

Figure 10C:
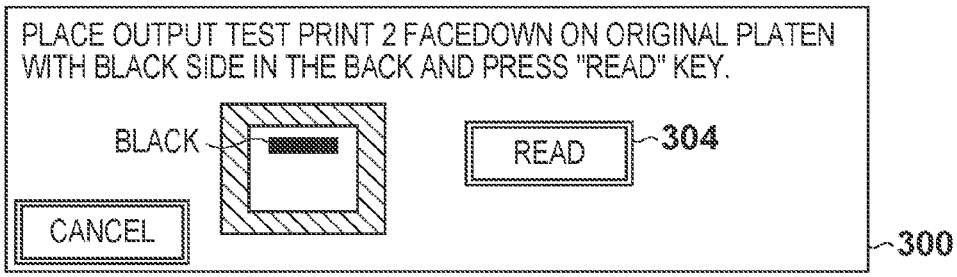
Figure 10D:
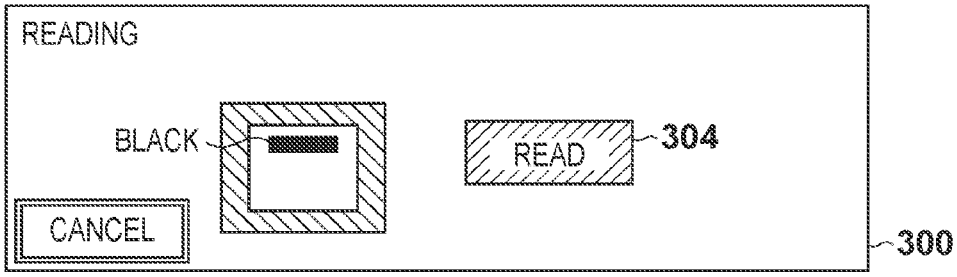
Figure 10E:
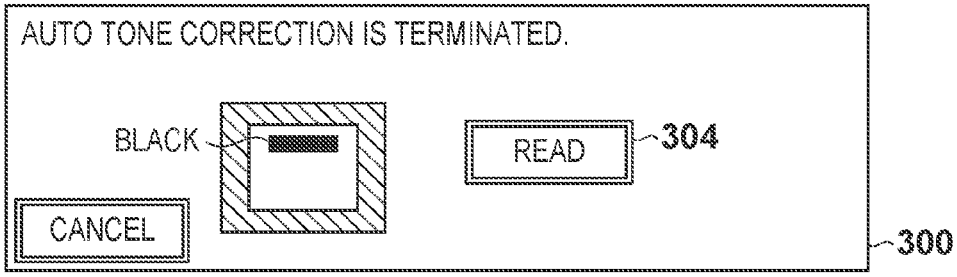
Figure 14:
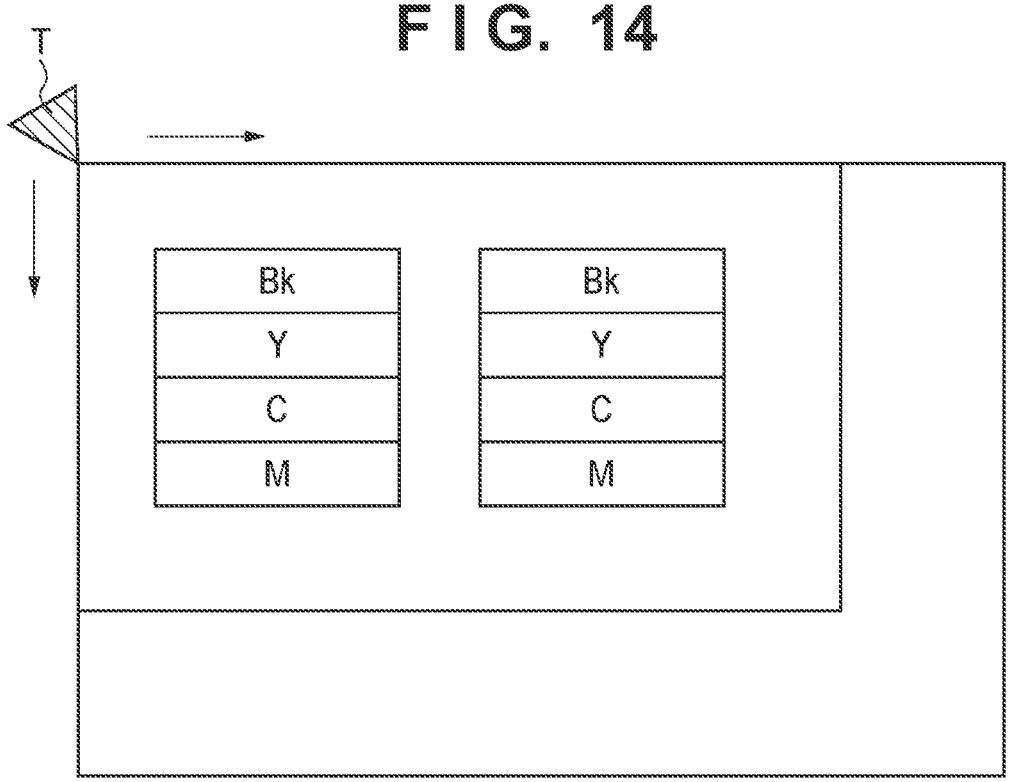
FIG. 14 is a diagram showing how the test print 2 according to the present invention is placed on the original reading unit 500.

Next, in step S707, the test print 2 is placed on the original platen, and reading is started. FIG. 14 is a schematic view of an output of the test print 2 as seen from above when placed on the original platen glass 501, and the wedge-shaped mark T on the upper left indicates the mark for alignment of an edge of the original on the original platen. The operator is required to place the test print 2 in such a manner that the Bk pattern is located on the alignment mark T side and the original is placed with the proper side up. Thus, on the operation panel, a message shown in FIG. 10C is displayed. This makes it possible to prevent a control error due to misplacement.

During reading of a pattern, the original reading unit 500 gradually performs scanning from the alignment mark T, calculates the positions of the patches of each color in the pattern as coordinates relative to the coordinate point at which the first density gap is detected, and performs reading. With regard to the number of points to be read per patch (309 in FIG. 12), 16 points to be read are set in a single patch, and obtained signals are averaged. The number of points may be optimized for the reading apparatus or the image processing apparatus.

Figure 17:
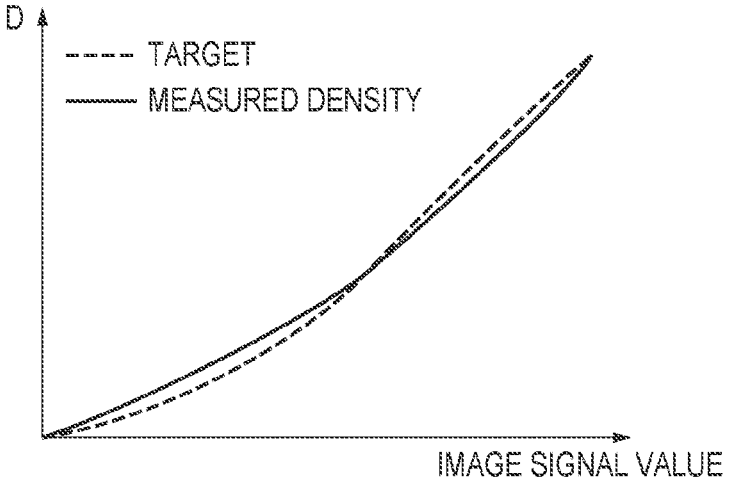
FIG. 17 is a graph illustrating how tone characteristics are created during auto tone correction processing according to the present invention.

RGB signals, which are averages of the values at 16 points of each patch, are converted to density values using the above-described method for conversion to optical density, and the converted density values are plotted as the output density on a graph whose horizontal axis represents the image signal value. FIG. 17 shows the resultant graph. A target curve in FIG. 17 represents optimum density tone characteristics that are sought by this image forming apparatus, while the measured curve deviates from the target curve. Therefore, in step S708, the CPU 101 changes the γLUT so that the measured curve conforms to the target curve, and thus the auto tone correction processing is terminated.

First Embodiment

Figure 18:
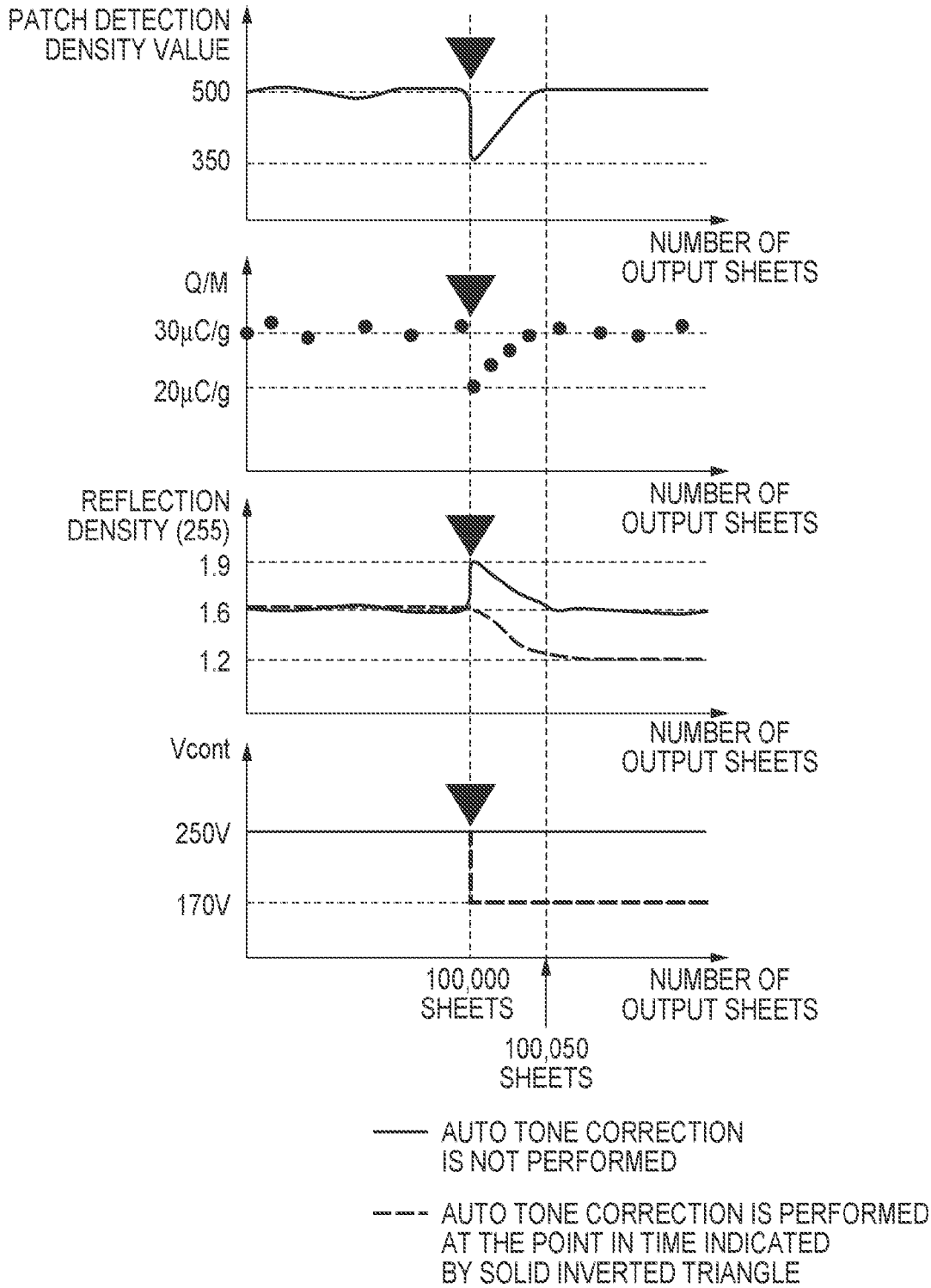
FIG. 18 is a graph illustrating a problem to be solved by the present invention.

Hereinafter, a first embodiment of the present invention will be described with reference to FIGS. 18 to 21. As described above, if the state, such as the toner charge characteristics, of the developing material changes after the auto tone correction processing, in some cases, optimum density tone characteristics can no longer be maintained. FIG. 18 shows specific results of verification. In FIG. 18, the horizontal axis represents the number of output sheets (A4 size), and the vertical axes represent the result of detection by the patch detection ATR sensor 26 of an image forming apparatus according to the present embodiment, the toner charge characteristics Q/M of a developing material image on the photosensitive drum 1, the result of measurement of the reflection density of a monochromatic toner image of an image signal having a signal level of 255 (the measurement was conducted using a reflection densitometer manufactured by X-Rite, Incorporated), and changes in the set value of Vcont. The triboelectric toner charge amount Q/M can be measured in the following manner: the developing material image on the photosensitive drum 1 is attracted, and the amount of electric charge Q and the weight M of the attracted toner are measured.

Here, a relationship among the patch detection signal value, Q/M, and the reflection density in the case where Vcont is constant will be described. Formation of a patch latent image is always performed under the same latent image conditions, and therefore it is possible to find Q/M from the toner density of the patch image (the reference developing material image) on the drum. In the case where the patch detection signal value is small, the toner density on the photosensitive drum is high, and therefore Q/M is decreased. Moreover, since the toner density of the patch image on the photosensitive drum is high, the reflection density of the toner image to be output is high. Conversely, in the case where the patch detection signal value is high, Q/M is elevated, and the reflection density of the toner image is low.

It can be seen that at the position (at the point in time when 100,000 sheets have been used) indicated by solid inverted triangles in FIG. 18, the patch detection signal value suddenly decreases and Q/M suddenly decreases. This is because the image forming apparatus was not used for one week and thus the toner charge amount decreased. At this time, the value of the density on paper suddenly rises. Afterward, when the patch detection signal value and Q/M returned to their original levels after the use of about 50 more sheets, the density on paper also returned to its original level. Thus, when the density on paper changes at the position indicated by the solid inverted triangle as shown in FIG. 18 and it is therefore attempted to adjust the density by performing auto tone correction processing, Vcont is decreased because Q/M has decreased. Therefore, as shown by the broken line in FIG. 18, as the patch detection signal value and Q/M return to their original levels, the density on paper decreases, and thereafter the density on paper remains at the decreased level.

Figure 19:
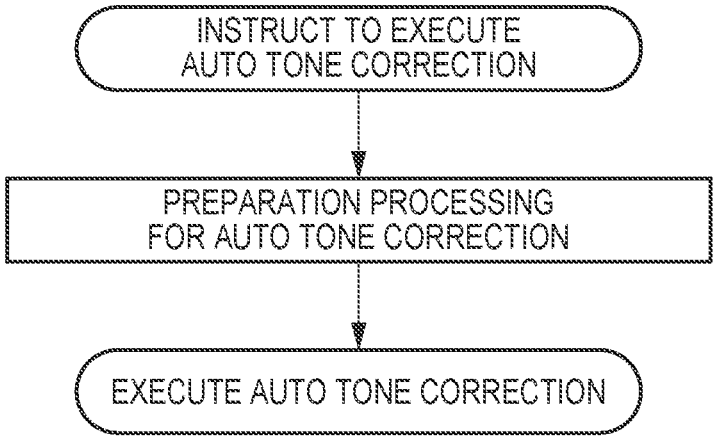
FIG. 19 is a diagram showing the timing at which preparation processing for auto tone correction processing is performed according to a first embodiment.

In order to solve such a problem, in the present embodiment, as shown in FIG. 19, after receipt of an instruction to perform auto tone correction processing and before transition to auto tone correction processing, the process proceeds to "preparation processing for auto tone correction processing" in which the toner charge characteristics are checked and adjusted to be within a predetermined range. It is possible to always execute auto tone correction processing with toner charge characteristics within the predetermined range by performing the "preparation processing for auto tone correction processing" and to thereby solve the above-described problem. Here, the "preparation processing for auto tone correction processing" is a preparation operation that is performed before performing tone correction control, which is performed prior to image formation, and is a mode that restores a T/Dev proportion of the developing material in the developing device to a proportion within a predetermined range. Specifically, at least one of a toner supply operation of forming a patch image prior to image formation and supplying the toner to the developing device based on the density of the patch image, a discharge operation of discharging the toner onto the photosensitive drum, and an idling operation of the developing device is executed.

In the present embodiment, it is checked whether or not the toner charge amount is within a predetermined range based on the patch detection signal value, and if the toner charge amount is outside the predetermined range, the state of the developing material in the developing device is adjusted so that the toner charge amount falls within the predetermined range before performing auto tone correction processing. With this method, it is possible to suppress a change in the density tone characteristics due to a change in the toner charge amount after auto tone correction processing.

Figure 20:
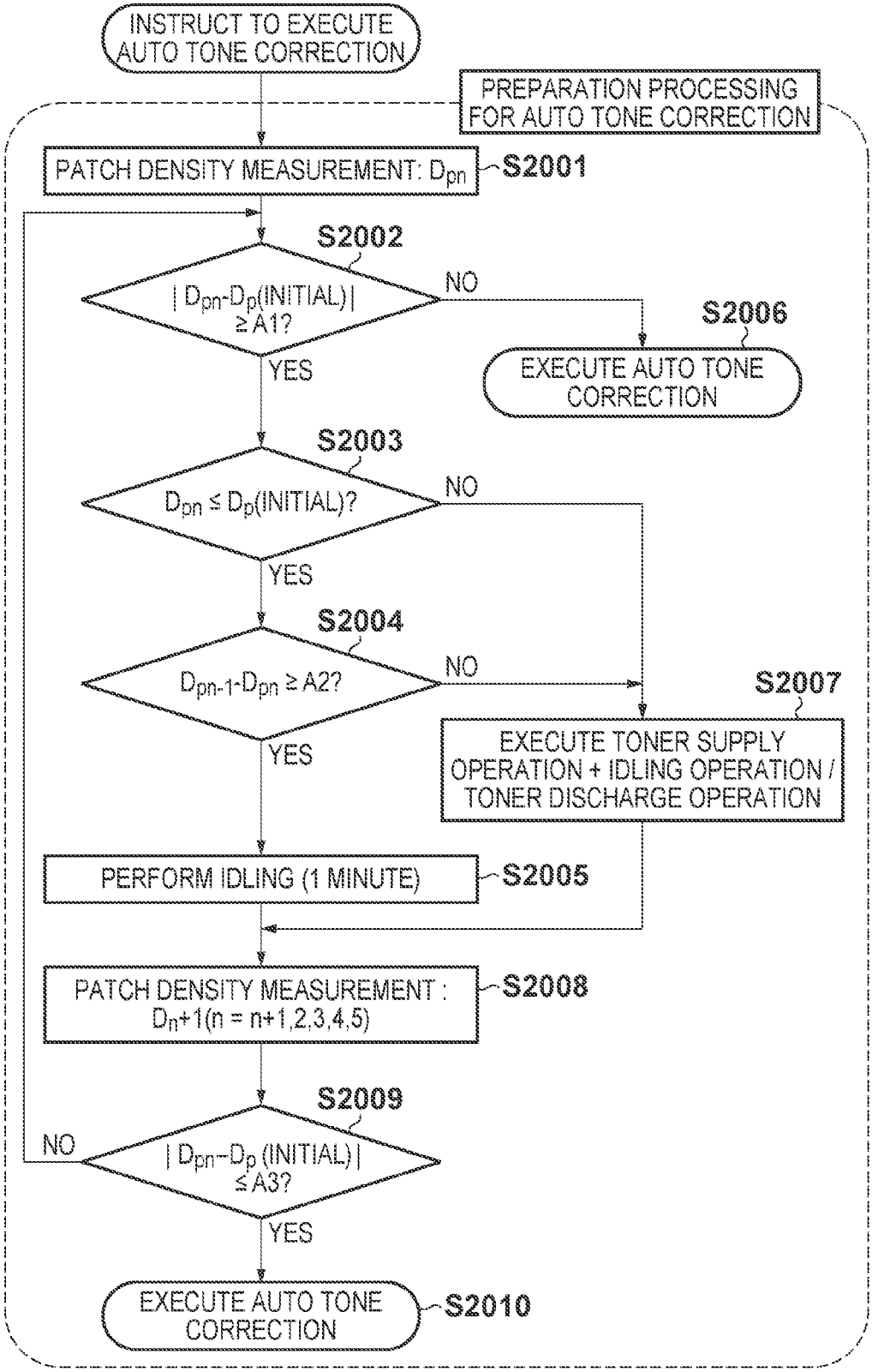
FIG. 20 is a flowchart of the preparation processing for auto tone correction processing according to the first embodiment.

Hereinafter, a specific method will be described with reference to FIG. 1 and a flowchart in FIG. 20. Once the "Auto tone correction processing" mode setting button is pressed, an instruction to execute auto tone correction processing is transmitted to the CPU 101. The CPU 101 outputs a display indicating that preparations for auto tone correction processing are being made before presenting a display regarding output of the test print 1 on the display 300. At the same time, in step S2001, the CPU 101 sends an instruction to create a patch image and records a read patch detection signal value $D_{pn}$ in the RAM 103.

Then, in step S2002, the CPU 101 reads out the value of the patch detection signal value $D_p$(initial) with the initial developing material (the reference value) that is recorded in the RAM 103, and compares the values of $D_{pn}$ and $D_p$(initial). If there is a large difference between the two values, it is possible to judge that the charge characteristics of the developing material significantly deviate from the reference value. In other words, if $|D_{pn}-D_p(\text{initial})|\geq A1$ (a threshold value), it is judged that the charge characteristics of the developing material significantly deviate from the reference value (Yes), and the process is advanced to step S2003. Although A1 was set to 30 in the present embodiment, A1 may be set to other values. This value assumes the case where Q/M has changed from its initial value by 2 μC/g. By decreasing the value of A1, it is possible to execute auto tone correction processing under conditions in which the charge characteristics of the developing material have been closely aligned. On the other hand, if the conditions of step S2002 are not satisfied (No), the process is advanced to step S2006, and auto tone correction processing is executed without performing any processing.

Then, in step S2003, the CPU 101 judges whether or not the charge characteristics (the toner charge amount) of the developing material are less than or equal to the reference value. If $D_{pn}\leq D_p$(initial), this means that Q/M is lower than its initial value. In this case, that is, if the conditions of step S2003 are satisfied (Yes), the process is advanced to step S2004. On the other hand, if the conditions of step S2003 are not satisfied (No), Q/M is higher than the initial value, and therefore the process is advanced to step S2007, and adjustment processing for decreasing Q/M is executed. In order to decrease Q/M, it is necessary to increase the proportion of the toner (T) in the developing material (Dev) T/Dev by supplying the toner in the developing material. After the toner is supplied, the Q/M distribution in the developing material is not uniform, and it is possible to make the Q/M distribution uniform and decrease the value of Q/M by performing the idling operation to sufficiently stir the developing material and thereby adjust the value of Q/M to a value appropriate for T/Dev.

In step S2004, the CPU 101 judges whether to perform the idling operation or to discharge the toner. Specifically, the CPU 101 reads out a patch detection signal value $D_{pn-1}$ of a patch image (a reference developing material image) that has been formed directly before $D_{pn}$, or in other words that has been formed the last time, from the RAM 103 and compares the value of $D_{pn-1}$ with the patch detection signal value $D_{pn}$ of the patch image that is formed this time.

As will be described below, in step S2004, if the relationship $$D_{pn-1}-D_{pn}\geq A2$$

holds (Yes), Q/M suddenly decreases in a short period of time, which is a control interval of the patch detection ATR, and in this case, it can be substantially concluded that the developing material has been left to stand during the control intervals of the patch detection ATR. Therefore, it can be judged that it is better to increase the Q/M by stirring the developing material by idling rather than by discharging the toner, and thus the idling operation is performed. It should be noted that although the idling time was set to one minute, the idling time may be set to other lengths of time.

On the other hand, if the conditions of step S2004 are not satisfied (No), the decrease in Q/M during the control intervals of the patch detection ATR is not significant, and it can be judged that the influence of being left to stand is small. Accordingly, the process is advanced to step S2007, and instead of performing the idling operation, a step in which the toner in the developing material is discharged onto the photosensitive drum 1 to decrease the proportion T/Dev of the toner (T) in the developing material (Dev) and to thereby increase Q/M is performed. Here, in the step in which the toner in the developing material is discharged onto the photosensitive drum 1, the developing material is stirred while decreasing T/Dev, and therefore the idling operation is not required. It should be noted that although A2 was set to 15 in the present embodiment, A2 may be set to other values. However, it is necessary to satisfy A1≥A2.

Here, in step S2007, the amount of toner to be supplied or the amount of toner to be discharged in the case where step S2003 is not satisfied (No) and in the case where step S2004 is not satisfied (No) will be described. With regard to the amount of toner to be supplied or the amount of toner to be discharged in step S2007, an amount corresponding to the supply correction amount Mp can be supplied or discharged based on the patch detection signal values $D_{pn}$ and $D_p$(initial) and the above-described Formula 3, and therefore the amount of toner to be discharged/to be supplied is set to Mp.

When step S2005 or S2007 is terminated, the process is advanced to step S2008, and the CPU 101 measures the patch density again and, in step S2009, judges whether or not the patch detection signal value $D_{pn+1}$ measured satisfies the following relationship:

$$|D_{pn+1}-D_p(\text{initial})|\leq A3$$

If the relationship is satisfied (Yes), it is judged that the charge characteristics of the developing material have returned to the reference value, the process is advanced to step S2010, and auto tone correction processing is executed. Although A3 was set to 10 in the present embodiment, A3 may be set to other values.

On the other hand, if the conditions of step S2009 are not satisfied (No), the process is returned to step S2002, and an operation for adjusting the charge characteristics of the developing material is performed. At this time, n=n+1, and subsequently, each time this cycle is repeated, the number increases from n+1 to n+2, n+3, n+4, and n+5. It should be noted that, if the conditions of step S2009 are not satisfied even when n=n+5, there is a possibility that the charge ability of the developing material may be decreased due to a deterioration in the toner. Therefore, in this case, "toner replacement processing" that discharges the toner in the developing material onto the photosensitive drum once and supplies a new toner is performed to recover the charge ability of the developing material. For example, it is desirable to replace an amount of toner corresponding to a proportion T/Dev of the toner (T) in the developing material (Dev) of 2%; however, this amount may be set to other values. After the "toner replacement processing" is performed, the process is returned to step S2005, and the adjustment operation of the charge characteristics of the developing material is performed.

Furthermore, if the conditions of step S2009 are not satisfied even when n=n+10, there is a possibility that there may be a malfunction in the image forming apparatus, in particular, there may be a malfunction in the patch detection ATR sensor 26, the developing device 2, the photosensitive drum 1, the charge roller 11, the scanner 12, or the like. Accordingly, the CPU 101 suspends the "preparation processing for auto tone correction processing" and causes the display unit of the image forming apparatus to display a message indicating that maintenance service is needed on the display 300.

Next, the effects of performing the "preparation processing for auto tone correction processing" according to the present embodiment will be described with reference to FIG. 21. It can be seen that at the position indicated by solid inverted triangles in FIG. 21 (at the time when 100,000 sheets have been used), the patch detection signal value suddenly decreases, and Q/M suddenly decreases. In this case, since the value of the density on paper suddenly increased, auto tone correction processing was performed. Solid lines and solid circles indicate the values in the case where the "preparation processing for auto tone correction processing" according to the present embodiment was performed at that time, and broken lines and hollow circles indicate the values in the case where the processing was not performed. As shown in FIG. 21, in the case where the "preparation processing for auto tone correction processing" was not performed (the broken lines and the hollow circles), Vcont has already decreased at the time of auto tone correction processing, and thus the density on paper decreases after auto tone correction processing. On the other hand, in the case where the "preparation processing for auto tone correction processing" was performed, it can be seen that the density on paper is stable even after auto tone correction processing. From the foregoing, it was possible to confirm the effects of the "preparation processing for auto tone correction processing".

Second Embodiment

In the above-described first embodiment, the patch density was measured, and the "preparation processing for auto tone correction processing" was performed based on the measured value. However, with this method, it is necessary to always form a patch image. Even though it is necessary to perform this step in such a situation where the patch density significantly deviates from the initial value (for example, after being left to stand for a long period of time, or due to environmental fluctuation), in the case where auto tone correction processing is performed in order to adjust the tint even more during use of the image forming apparatus, it is not necessary to execute the above-described preparation processing for auto tone correction processing. In other words, during use of the image forming apparatus, the charge characteristics of the developing material are kept within the predetermined range by the patch detection ATR control, and therefore there is no point in forming a patch image. To address this issue, in the present embodiment, a step of judging whether it is appropriate to perform the "preparation processing for auto tone correction processing" according to the first embodiment is added by causing a temperature and humidity sensor installed in the image forming apparatus or the RAM 103 to record a log of operations of the image forming apparatus and using the recorded results. Thus, it is possible to reduce unnecessary downtime or wasteful toner consumption that would arise when auto tone correction processing is performed, while receiving the benefit of the effects of the above-described first embodiment.

First, an example of the configuration of an image forming apparatus according to the present embodiment will be described with reference to FIG. 23. It should be noted that the following description only provides an explanation of components and technologies different from those of the first embodiment.

Figure 23:
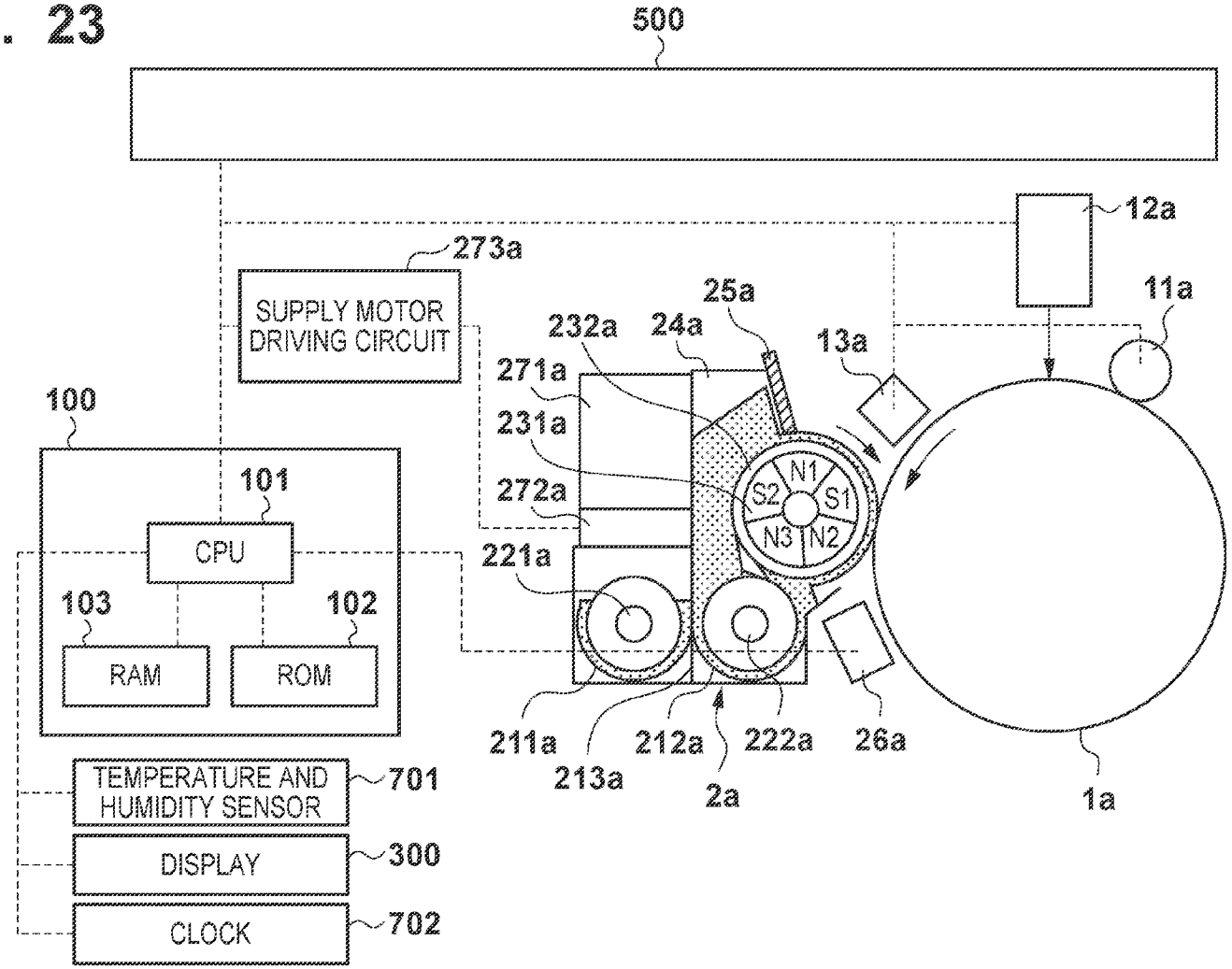
FIG. 23 is a simplified cross-sectional view of an image forming apparatus according to the second embodiment.

As shown in FIG. 23, the image forming apparatus according to the present embodiment includes a temperature and humidity sensor 701 and a clock 702 in addition to the components of the first embodiment. The temperature and humidity sensor 701 records data on the temperature, humidity, and absolute moisture content W in the image forming apparatus in the RAM 103. The clock 702 records the time of day when a print signal is issued and the time of day when the developing device 2 operates in the RAM 103. Moreover, the image forming apparatus according to the present embodiment records the number of sheets on which the developing material has been used in the RAM 103.

Figure 22:
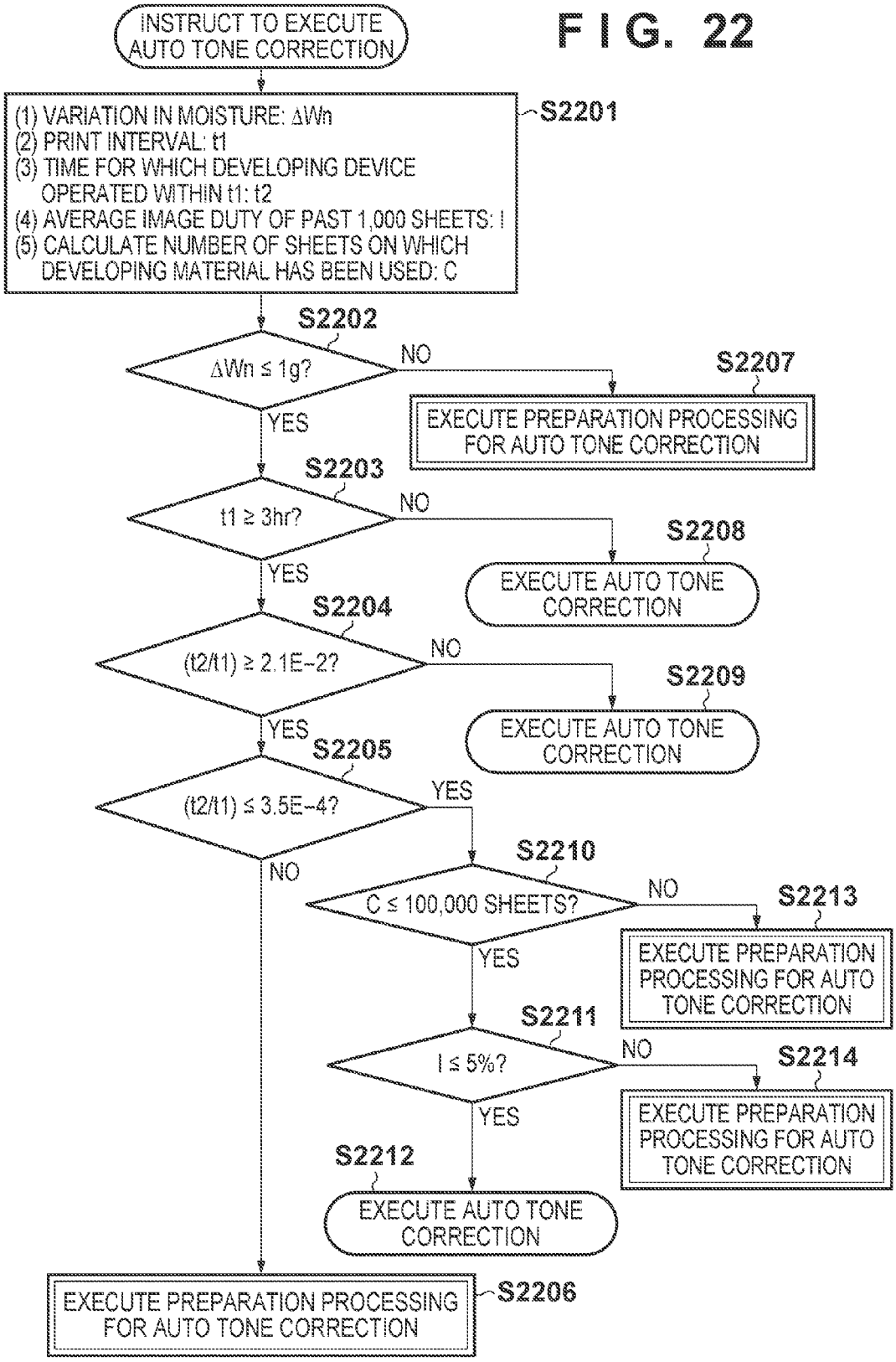
FIG. 22 is a flowchart according to a second embodiment.

Next, a processing procedure according to the present embodiment will be described with reference to a flowchart in FIG. 22. Once the "Auto tone correction processing" mode setting button is pressed, an instruction to execute auto tone correction processing is transmitted to the CPU 101. The CPU 101 outputs a display indicating that preparations for auto tone correction processing are being made before presenting a display regarding output of the test print 1 on the display 300. At the same time, in step S2201, the CPU 101 reads out the following information (1) to (5) from the RAM 103:

(1) the variation in moisture after the immediately preceding printing: ΔWn (2) the elapsed time (print interval) after the immediately preceding printing: t1

(3) the time for which the developing device 2 operated within the print interval t1, that is, within the aforementioned elapsed time: t2

(4) the average image duty indicating the ratio of the image forming area with respect to the past 1,000 sheets: I (obtained as the ratio of an average value of video count values of the past 1,000 sheets to a video count value at the time of a 255 signal)

(5) the number of sheets on which the developing material has been used (the number of sheets used from the initial developing material), that is, the number of image forming materials: C The CPU 101 determines whether or not to perform the preparation processing for auto tone correction processing, which has been described in the first embodiment, using at least one of these pieces of information. Hereinafter, an example of determination processing that uses these pieces of information will be described. It should be noted that it is also possible to apply judgement conditions different from those of the determination processing described below to the present invention.

In step S2202, the CPU 101 judges whether or not the variation in moisture ΔWn satisfies the following relationship:

$$\Delta Wn \leq 1 \text{ g}$$

If the relationship is satisfied (Yes), it is judged that the variation in moisture is not large, and the process is advanced to step S2203 without executing the preparation processing for auto tone correction processing. On the other hand, if the result of judgement is "No", the process is advanced to step S2207, and the preparation processing for auto tone correction processing is executed. It should be noted that with respect to the value of 1 g, other values may also be adopted.

Then, in step S2203, the CPU 101 judges whether or not the print interval t1 satisfies the following relationship:

$$t1 \geq 3 \text{ hr}$$

It the relationship is satisfied (Yes), since the print interval is 3 hours or longer, it is judged that there is an influence of being left to stand, and the process is advanced to step S2204. On the other hand, if the result of judgement is "No", the process is advanced to step S2208, and it is judged that the influence of environmental fluctuation or being left to stand is small and therefore there is no problem. Thus, auto tone correction processing is performed without executing the preparation processing for auto tone correction processing. It should be noted that with respect to the value of 3 hr, other values may also be adopted.

Then, in step S2204, the CPU 101 judges whether or not the print interval t1 and the operating time t2 of the developing device 2 satisfy the following relationship:

$$(t2/t1) \geq 2.1E-2$$

If the relationship is not satisfied (No), it is possible to judge that the developing device 2 performs the idling operation at least 15 minutes per 12 hours and the influence of environmental fluctuation or being left to stand is small, and therefore the process is advanced to step S2209, and auto tone correction processing is executed without executing the preparation processing for auto tone correction processing. It should be noted that with respect to the value of 2.1E−2, other value may also be adopted. On the other hand, if the result of judgement is "Yes", there may be an influence of being left to stand depending on the state of the developing material, and therefore the process is advanced to step S2205.

Then, in step S2205, the CPU 101 judges whether or not the print interval t1 and the operating time t2 of the developing device 2 again satisfy the following relationship:

$$(t2/t1) \leq 3.5E-4$$

If the relationship is not satisfied (No), the developing device 2 only performs the idling operation for a period of time of less than 15 seconds per 12 hours, and there is a possibility that the charge characteristics may have changed because the developing material was left to stand. Therefore, the process is advanced to step S2206, and the preparation processing for auto tone correction processing is executed. Thus, the charge characteristics of the developing material are adjusted to fall within the predetermined range. It should be noted that with respect to the value of 3.5E−4, other values may also be adopted.

If both the relationships of steps S2204 and S2005 are satisfied (Yes), or in other words, if the idling time of the developing device 2 is at least 15 seconds and less than 15 minutes per 12 hours, there may be an influence of being left to stand depending on the state of the developing material, and therefore the process is advanced to step S2210.

Then, in step S2210, the CPU 101 judges whether or not the number of sheets on which the developing material has been used (the number of sheets used from the initial developing material), that is to say, the number of image forming materials satisfies the following relationship:

$$C \leq 100{,}000 \text{ sheets } (A4)$$

If, in the case where the relationship is satisfied (Yes), the developing device 2 performs the idling operation for a period of time of at least 15 seconds and less than 15 minutes per 12 hours, it is possible to judge that the influence of being left to stand on the developing material is small, and therefore the process is advanced to step S2211 without executing the preparation processing for auto tone correction processing. It should be noted that with respect to the value of 100,000 sheets, other values may also be adopted. On the other hand, if the result of judgement is "No", the process is advanced to step S2213, and the preparation processing for auto tone correction processing is executed.

Finally, in step S2211, the CPU 101 judges whether or not the average image duty I of the past 1,000 sheets satisfies the following relationship:

$$I \geq 5\%$$

If, in the case where the relationship is satisfied (Yes), the developing device 2 performs the idling operation for a period of time of at least 15 seconds and less than 15 minutes per 12 hours, it is judged that the influence of being left to stand on the developing material is small even when the developing material has been used on 100,000 or more sheets, and the process is advanced to step S2212, where auto tone correction processing is executed without executing the preparation processing for auto tone correction processing. It should be noted that with respect to the value of 5%, other values may also be adopted. On the other hand, if the result of judgement is "No", the process is advanced to step S2214, and the preparation processing for auto tone correction processing is executed.

As described above, according to the present embodiment, the preparation processing for auto tone correction processing can be appropriately performed when necessary, and therefore it is possible to reduce the unnecessary downtime or the toner consumption.

The present invention can provide an image forming apparatus that maintains the toner charge characteristics after auto tone correction processing and that reduces unnecessary downtime and wasteful toner consumption that would occur when auto tone correction processing is performed.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-279857 filed on Dec. 15, 2010, which is hereby incorporated by reference herein in its entirety.

What is claimed is:

1. An image forming apparatus including an image carrier, an exposure unit that forms an electrostatic latent image by exposing the image carrier, and a developing unit that contains a toner and a magnetic carrier as a developing material and that develops the electrostatic latent image formed on the image carrier into a developing material image, and executing auto tone correction processing in which a tone pattern formed on a recording material is read to adjust density tone characteristics, the apparatus comprising:

a forming unit that forms a reference developing material image on the image carrier using the exposure unit and the developing unit, before execution of the auto tone correction processing;

a density detecting unit that detects a density of the reference developing material image formed on the image carrier; and a control unit that, if a result of detection by the density detecting unit indicates that a toner charge amount of the developing material contained in the developing unit is within a predetermined range, allows the auto tone correction processing to be executed, and if the result of detection by the density detecting unit indicates that the toner charge amount of the developing material contained in the developing unit is outside the predetermined range, executes adjustment processing for adjusting the toner charge amount of the developing material contained in the developing unit to be within the predetermined range, before allowing the auto tone correction processing to be executed.

2. The image forming apparatus according to claim 1, wherein the adjustment processing includes at least one of an idling operation for stirring the toner and the magnetic carrier contained in the developing unit, a toner supply operation that supplies the toner to the developing unit, and a discharge operation that discharges the toner onto the image carrier.

3. The image forming apparatus according to claim 2, wherein if the difference between a density value of the reference developing material image detected by the density detecting unit and a reference value that is preliminarily stored in a storage unit of the image forming apparatus exceeds a predetermined threshold value and if the density value is larger than the reference value, the control unit executes the idling operation after executing the toner supply operation as the adjustment processing.

4. The image forming apparatus according to claim 2, wherein if the difference between a density value of the reference developing material image detected by the density detecting unit and a reference value preliminarily stored in a storage unit of the image forming apparatus exceeds a predetermined threshold value, if the density value is smaller than or equal to the reference value, and if a density value of a latest reference developing material image formed has not decreased from a density value of an immediately preceding reference developing material image formed by an amount exceeding a predetermined threshold value, the control unit executes the discharge operation as the adjustment processing.

5. The image forming apparatus according to claim 2, wherein if the difference between a density value of the reference developing material image detected by the density detecting unit and a reference value that is preliminarily stored in a storage unit of the image forming apparatus exceeds a predetermined threshold value, if the density value is smaller than or equal to the reference value, and if a density value of a latest reference developing material image formed has decreased from a density value of an immediately preceding reference developing material image formed by an amount exceeding a predetermined threshold value, the control unit executes the idling operation as the adjustment processing.

6. The image forming apparatus according to claim 1, wherein if the toner charge amount of the developing material does not fall within the predetermined range even after the adjustment processing is executed, a display that prompts maintenance of the image carrier and the developing unit is output to a display unit of the image forming apparatus.

7. The image forming apparatus according to claim 1, wherein the control unit comprises:

a determination unit that determines to allow the auto tone correction processing to be executed without executing the adjustment processing regardless of whether or not the toner charge amount of the developing material contained in the developing unit is within the predetermined range, using at least one of information on a variation in moisture since formation of an immediately preceding image, information on an elapsed time since formation of the immediately preceding image, information on a time for which the developing unit operated within the elapsed time, information on an average image duty indicating a ratio of an image forming area in past image formation, and information on a number of image forming materials.

* * * * *